US007591705B2

(12) United States Patent
Ciccarelli et al.

(10) Patent No.: US 7,591,705 B2
(45) Date of Patent: Sep. 22, 2009

(54) MINIATURE EXPANDABLE TOY TRAIN SYSTEM

(75) Inventors: Stephen Ciccarelli, Huntingdon Valley, PA (US); Alan Dorfman, Langhorne, PA (US); Michael Kind, Ambler, PA (US); Steven Menow, Yardley, PA (US); Tomoru Tohyama, Tokyo (JP)

(73) Assignee: The Good Stuff Company, LLC, New York, NY (US)

( * ) Notice: Subject to any disclaimer, the term of this patent is extended or adjusted under 35 U.S.C. 154(b) by 440 days.

(21) Appl. No.: 10/966,448

(22) Filed: Oct. 15, 2004

(65) Prior Publication Data

US 2005/0112985 A1 May 26, 2005

Related U.S. Application Data

(60) Provisional application No. 60/512,544, filed on Oct. 17, 2003.

(51) Int. Cl.
*A63H 17/14* (2006.01)
*A63H 17/00* (2006.01)

(52) U.S. Cl. ..... 446/433; 446/470; 446/487; 238/10 R

(58) Field of Classification Search ..... 446/80, 446/433, 465, 469, 471, 487, 434, 94, 95, 446/470, 467; 238/10 R
See application file for complete search history.

(56) References Cited

U.S. PATENT DOCUMENTS

| | | | | | |
|---|---|---|---|---|---|
| RE10,114 | E | | 5/1882 | Reed | |
| 1,204,882 | A | * | 11/1916 | Kidder | 446/470 |
| 2,665,522 | A | | 1/1954 | Junod | |
| 3,316,401 | A | * | 4/1967 | Cramer | 246/415 A |
| 3,439,445 | A | | 4/1969 | Tarrson | |
| 3,579,904 | A | | 5/1971 | Genin | |
| 3,775,897 | A | * | 12/1973 | Soulakis et al. | 446/487 |
| 4,179,066 | A | * | 12/1979 | Teter | 238/10 E |
| 4,349,983 | A | | 9/1982 | Kilroy et al. | |
| 4,516,948 | A | * | 5/1985 | Obara | 446/95 |
| 4,530,670 | A | * | 7/1985 | Ohno | 446/94 |
| 4,674,990 | A | * | 6/1987 | Ohno | 446/376 |
| 4,685,892 | A | * | 8/1987 | Gould et al. | 446/109 |
| 4,753,346 | A | * | 6/1988 | Tsuji | 206/371 |
| 4,937,207 | A | * | 6/1990 | Simmell et al. | 463/62 |
| 4,940,195 | A | * | 7/1990 | Jackson | 244/1 R |
| 4,941,611 | A | | 7/1990 | Arsenault | |
| 4,953,785 | A | * | 9/1990 | Keska | 238/10 A |
| 5,458,521 | A | * | 10/1995 | Todd | 446/73 |
| 5,779,145 | A | * | 7/1998 | Zelle et al. | 238/10 E |

(Continued)

*Primary Examiner*—Kien T Nguyen
(74) *Attorney, Agent, or Firm*—Kramer Levin Naftalis & Frankel LLP

(57) ABSTRACT

A toy train is provided having a folding body with body segments joined by a hinge, adapted to engage a base having wheels. The folding body may be disassembled for storage in a generally flattened arrangement. A novel drive assembly for a toy train or toy train accessory is provided having a motor and a gear, which can be removably inserted in the base and covered by the folding body. A storage kit is provided including a storage case for storing a folding body of a toy train, a base for a toy train, and a drive assembly for a toy train. A toy train set is provided including tiles with raised train tracks. The tiles are joined by dovetail joints. Themed tiles are provided for creating a multi-themed play environment.

22 Claims, 30 Drawing Sheets

U.S. PATENT DOCUMENTS 5,924,910 A * 7/1999 Liu ..... 446/470
5,931,099 A * 8/1999 Bruner et al. ..... 104/53
5,951,358 A 9/1999 Hilko et al.
5,980,358 A * 11/1999 Diller ..... 446/467
6,155,177 A * 12/2000 Backfisch ..... 104/126
2001/0005663 A1 6/2001 Max

* cited by examiner

MINIATURE EXPANDABLE TOY TRAIN SYSTEM

BACKGROUND

Toy trains and toy train sets are popular toys for children, and also for adult collectors. Toy trains come in various sizes (gauges), and various track configurations. One key to a successful and fun toy train set system is increased play value. Play value can be derived from, for example, toy trains that can be assembled and disassembled, train sets depicting real life scenery and environments, moving train set accessories, and control of toy train movement.

One drawback of toy trains sets is that there are various parts, including the toy trains, toy train tracks, and any accessories for the toy train tracks, that can be lost, misplaced, or broken if not stored properly. This typically takes a great deal of time to set up, often requiring that the tracks be fastened to a permanent platform, requiring a dedicated space. There is currently no simple, space-saving and efficient way to disassemble a toy train set after use in a manner where the parts of the toy train set are stored conveniently, and in such a way as to keep the various parts together.

Toy train sets often consist of toy train set tracks. However, on the known low-cost sets that provide powered vehicles which look like locomotive engines, the tracks do not resemble "real" or life-size raised elevated rails, and instead have a slot running down the center of the tracks. The tracks are usually substantially flat. A toy train for use with such tracks includes a pin on its bottom for insertion into the slot. Such toy train sets lack play value in that the toy trains do not operate in a realistic manner, and do not actually ride on the rails of the train tracks.

Some toy train sets feature various lengths of track that must be joined together to complete the toy train set. These types of toy train sets take time to assemble before play can even begin, and aligning different lengths of toy train set tracks is not always easy. Play is thus delayed until the track is assembled.

Other toy train sets have a power source such as a battery-operated motor, or a wind-up spring powered motor. These motors are permanently fixed within the toy trains, and cannot be removed. Thus, disassembly and storage of such toy trains is impractical, since the permanent power source will limit whether the toy train can be disassembled and stored in a space-saving manner.

Accordingly, there exists the need for a toy train that can be easily assembled and disassembled.

There is further the need for a toy train that has various components that can be disassembled and stored in a convenient and space-saving manner.

There is further the need for a toy train set that has a power source that is removable from the toy train.

There is yet further the need for a toy train track set that can be conveniently assembled to create various themed environments.

SUMMARY

Briefly stated, the present invention provides a toy train system which provides simple storage, simple assembly, themed scenarios, and increased play value.

A toy train according to the present invention comprises a base portion including wheels for engaging a toy train track. Removably attached to the base is a folding body comprising at least two adjacent body segments connected by a hinge. When the base and body are assembled, a toy train is formed.

When disassembled, the body may be unfolded into a generally flattened arrangement for storage.

A drive assembly may be provided that engages the base and provides motive power to turn at least one of the wheels and drive the toy train. The toy train has one or more folding segments connected by a hinge, and may have folding segments that are connected by a hinge to a main or central body portion. In addition, the drive assembly may be adapted to power, for example, an accessory for a toy train having a moving part.

In another aspect of the present invention, a toy train storage kit is provided comprising a storage case for storing a toy train. A toy train having a foldable body that can be stored in a generally flattened arrangement is storable in the storage case. In addition, a drive assembly having a base with wheels and an optional tool may be stored in the storage case. The storage case has recesses for receiving the generally flattened body of the toy train, the base, the drive assembly, and/or the tool, or other components of the toy train storage kit.

In yet another aspect of the present invention, an expandable toy train set is provided. The expandable toy train set has a first tile having a first configuration that may be joined to a second tile having a second configuration. Each tile has raised toy train tracks for guiding a toy train. The tiles are connected with connectors that align the respective tracks on each tile to provide a smooth transition. In addition, the tiles may comprise themed tiles, having themed scenery details.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangement shown.

DETAILED DESCRIPTION OF THE PREFERRED EMBODIMENTS

Figure 1:
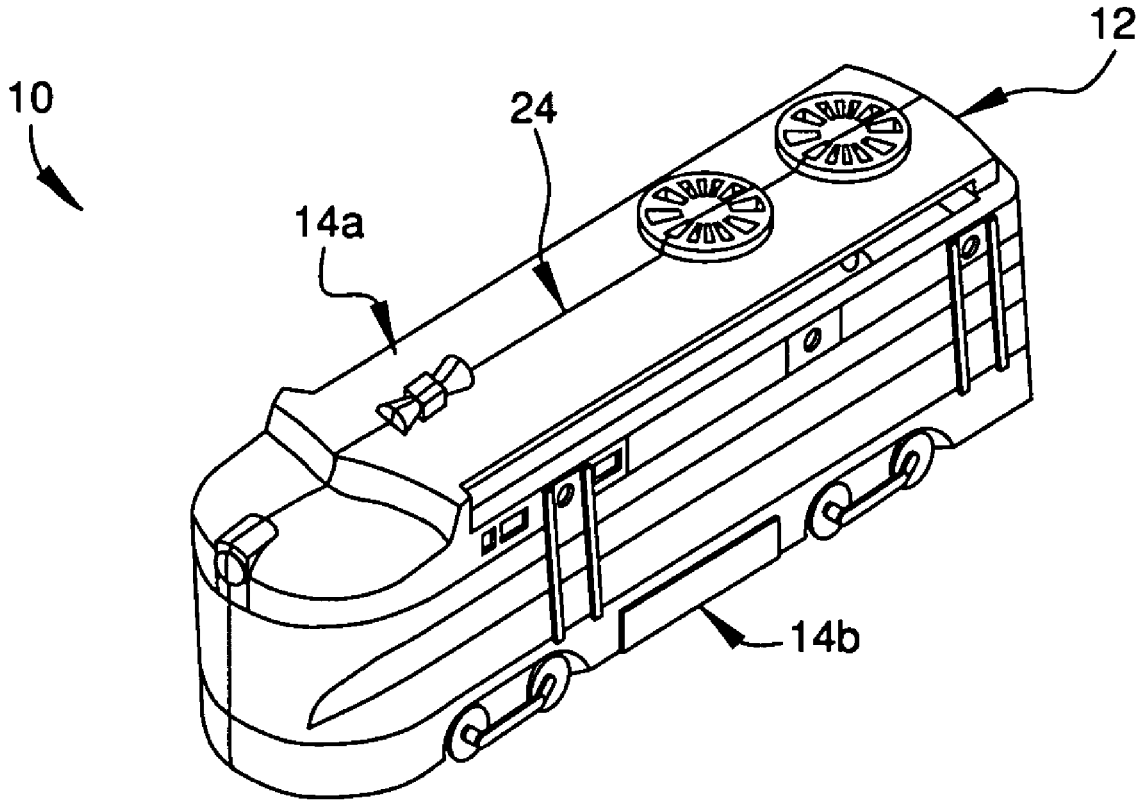
FIG. 1 is a perspective view of an embodiment of the folding body of a toy train according to the present invention.

Certain terminology is used in the following detailed description for convenience only and is not considered limiting. The word "upper" and "lower" designate directions in the drawings to which reference is made. Additionally, the terms "a" and "one" are defined as including one or more of the referenced item unless specifically noted.

Figure 2:
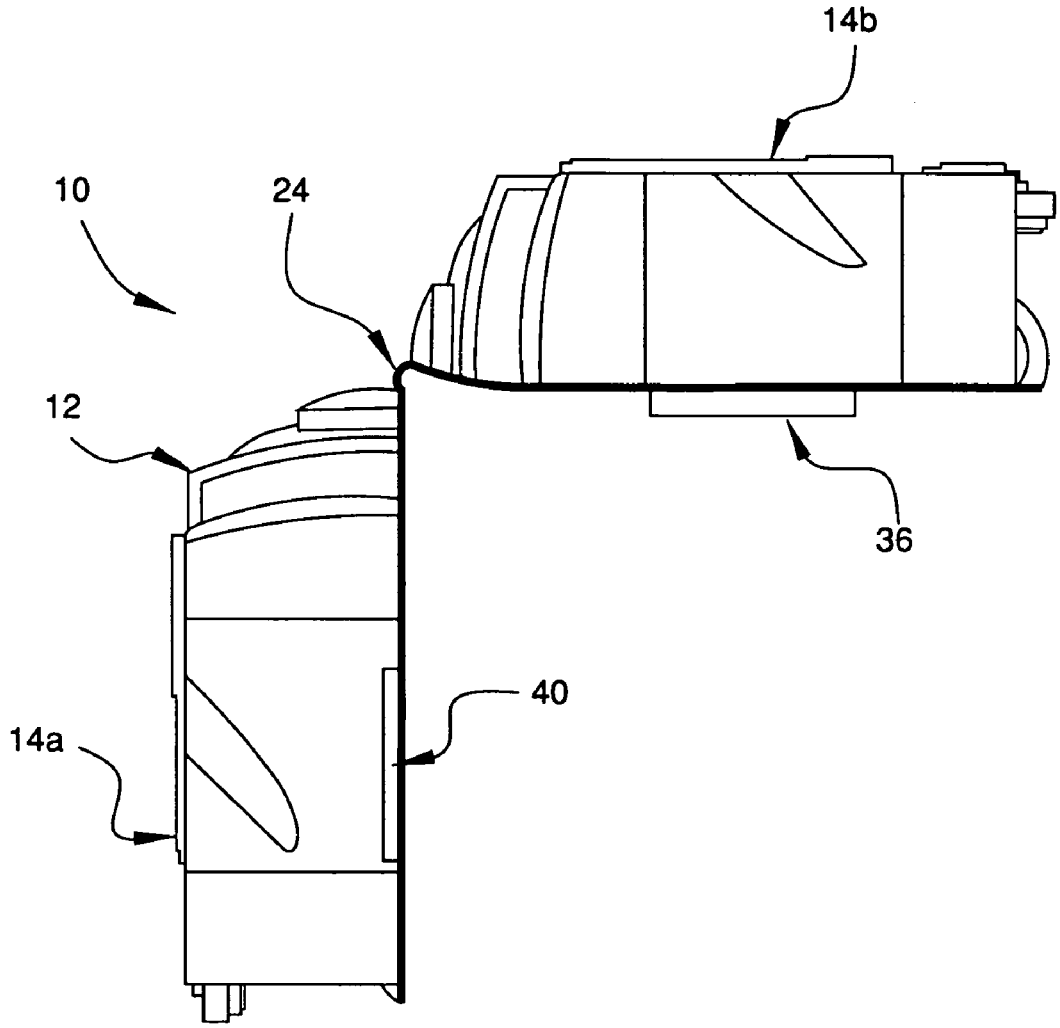
FIG. 2 is a front plan view of the embodiment of the toy train of the present invention shown in FIG. 1, with the folding body unfolded.

Referring now to FIGS. 1 and 2, a first embodiment of a toy train 10 according to the present invention is shown. The toy train 10 includes a folding body 12, and a base portion or base 48 having wheels 50, discussed in greater detail below. FIGS. 1 & 2 show the folding body 12, with the folding body 12 having two adjacent body segments 14*a* & 14*b* connected by a hinge 24. There is no limit as to the number of folding body segments that may be included in a toy train according to the present invention. Various examples are disclosed herein for illustration. It is appreciated that the various folding body segments described herein may be formed so that the folding body 12 "snaps" together for simple assembly and disassembly, such as by any acceptable arrangement of complementarily located projections, flanges, or slots that can be releasably engaged to one another, such as the projection 36 and slot 40 shown in FIG. 2. In a preferred embodiment, the folding body 12 is formed from plastic, and is molded and/or decorated to generally resemble a "real" or full-sized train, locomotive or rolling stock.

In one embodiment, the folding body 12 comprises two adjacent body segments 14*a* & 14*b* connected by a hinge 24. The hinge may take any form whereby the body segments 14*a* & 14*b* can move relative to each other. In a preferred embodiment, a living hinge is used. Hinge 24 may be a living hinge made of a resilient material, and preferably made of a resilient plastic. The hinge 24 can be formed as an integral part of the folding body 12, or may be a separate piece attached to any of the segments of the folding body 12. Alternately, the hinge 24 could be formed as a hinge that includes a hinge pin that allows two hinge segments to rotate thereabout.

The toy train is shown assembled in FIG. 1, and in a state of disassembly in FIG. 2, with the folding body 12 unfolding. As shown in FIG. 2, at least one of the folding body segments, for example body segment 14*a*, has a connection portion for engaging or aligning with an adjacent body segment 14*b*. The connection portion comprises a means for aligning the body segments 14*a* & 14*b*, such as a projection 36 extending from a side of the body segment 14*b* by way of example. The connection portion 36 may act to align and/or removably connect the adjacent body segments 14*a* & 14*b*.

In addition, one of the adjacent body segments, for example body segment 14*a*, may be formed with a receiving portion such as a slot 40 for removably engaging and/or aligning the projection 36 of an adjacent body segment 14*b*. In this manner, the body segments 14*a* & 14*b* will be aligned properly, and preferably also removably connected, allowing the toy train to be assembled. It is appreciated that the projection 36 and/or slot 40 may be formed on either of the body segments, and that a plurality of projections and slots may be used. Projection 36 and slot 40 form complementary connection portions.

Figure 3:
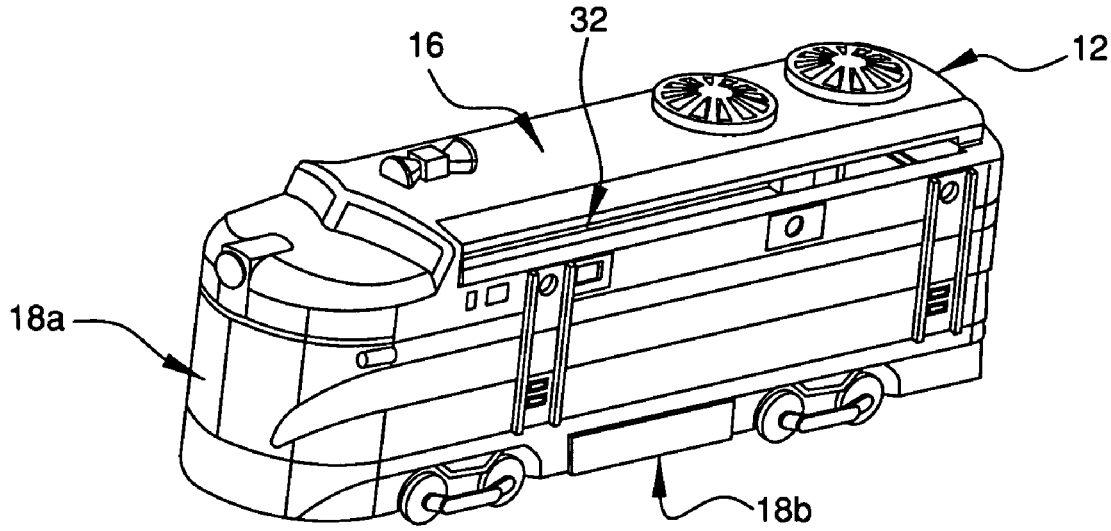
FIG. 3 is a perspective view of another embodiment of the folding body of a toy train according to the present invention.
Figure 4:
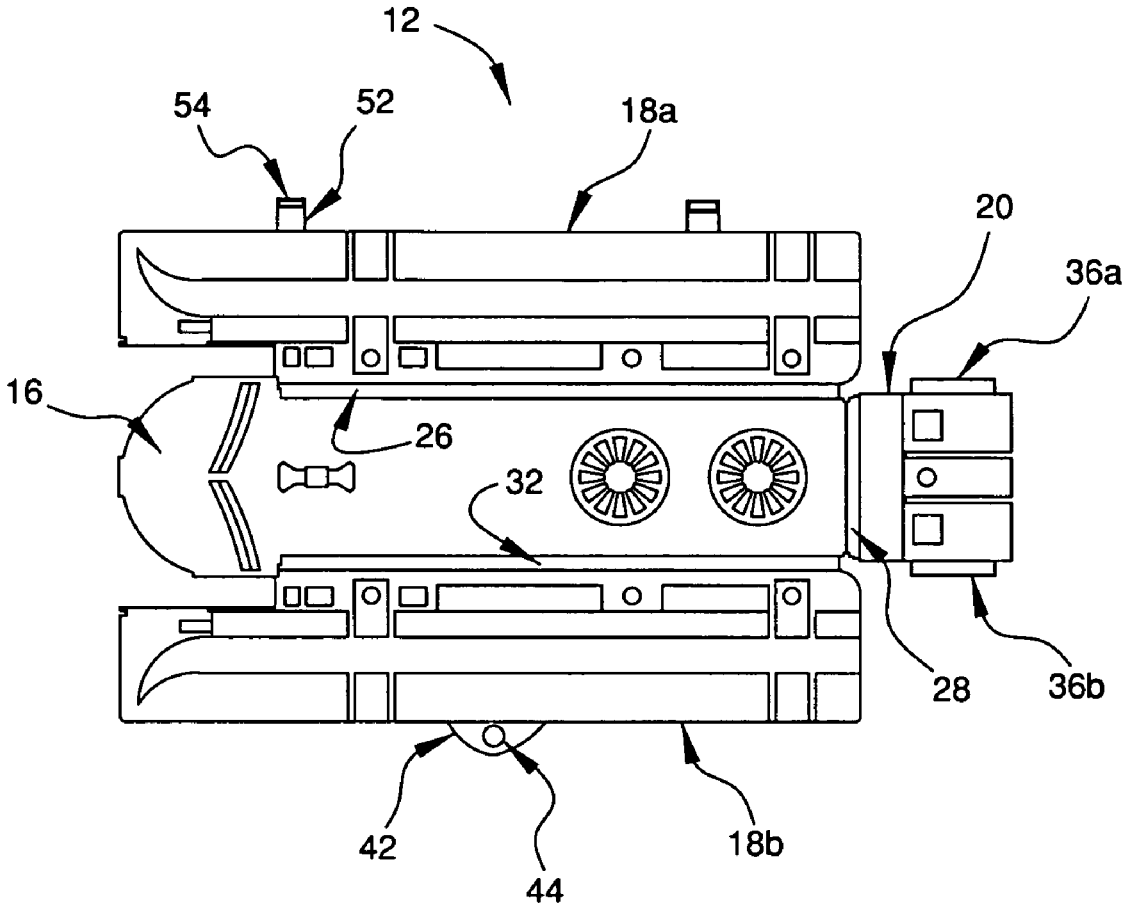
FIG. 4 is a top plan view of the folding body of a toy train shown in FIG. 3, with the folding body shown in the unfolded state.
Figure 5:
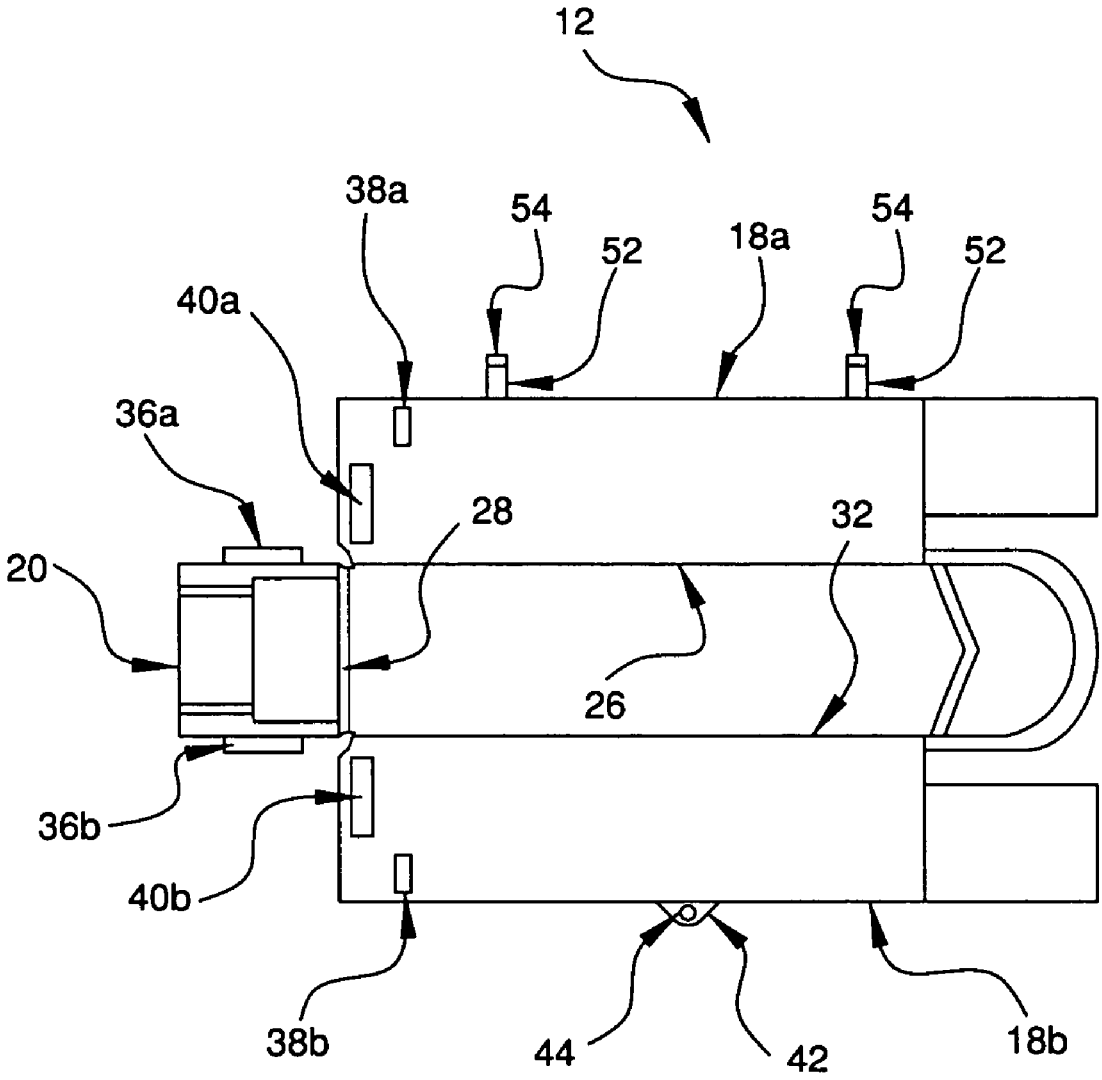
FIG. 5 is a bottom plan view of the folding body of the toy train shown in FIG. 3.

Another embodiment of the toy train according to the present invention is shown in FIG. 3-5, comprising a folding body 12 that includes a central body portion 16, two side body segments 18*a* & 18*b*, and a rear body segment 20. FIG. 3 shows the folding body 12 in an assembled position. In this example, the toy train 10 is formed to resemble a freight train locomotive. It is appreciated that the folding body 12 can be formed to resemble any type of train locomotive or rolling stock. By way of illustration, these may include, but are not limited, passenger trains, bullet trains, freight trains, locomotives, high speed rail trains, subway trains, elevated trains, different types of rolling stock, or others.

The side body segments 18*a* & 18*b* are connected to the central body segment 16 by hinges 26, 32 as shown in FIGS. 4 and 5. The rear body segment 20 is connected to the central body segment 16 by hinge 28. As shown in FIG. 4, in a preferred embodiment, rear body segment 20 has projections 36*a* & 36*b* which extend from opposite sides of the rear body segment 20 adjacent the side body segments 18*a* & 18*b*. As shown in FIG. 5, side body segments 18*a* & 18*b* preferably have slots 40*a* & 40*b*, respectfully, for removably engaging the projections 36*a* & 36*b*. In addition, side body segments 18*a* & 18*b* may have stops 38*a* & 38*b* to assist in aligning the folding body 12 when the toy train is assembled. A portion of the rear body segment 20 rests against stops 38*a* & 38*b* when the toy train is assembled. One of the body segments 18*a* may be provided with a flange 52 having a lip 54 for engaging the base of a toy train, as discussed in further detail below. In addition, side body segments 18*a* & 18*b* may have stops 38*a* & 38*b* to assist in aligning the folding body 12 when the toy train is assembled. The rear body segment 20 rests against stops 38*a* & 38*b* when the toy train is assembled.

Figure 6A:
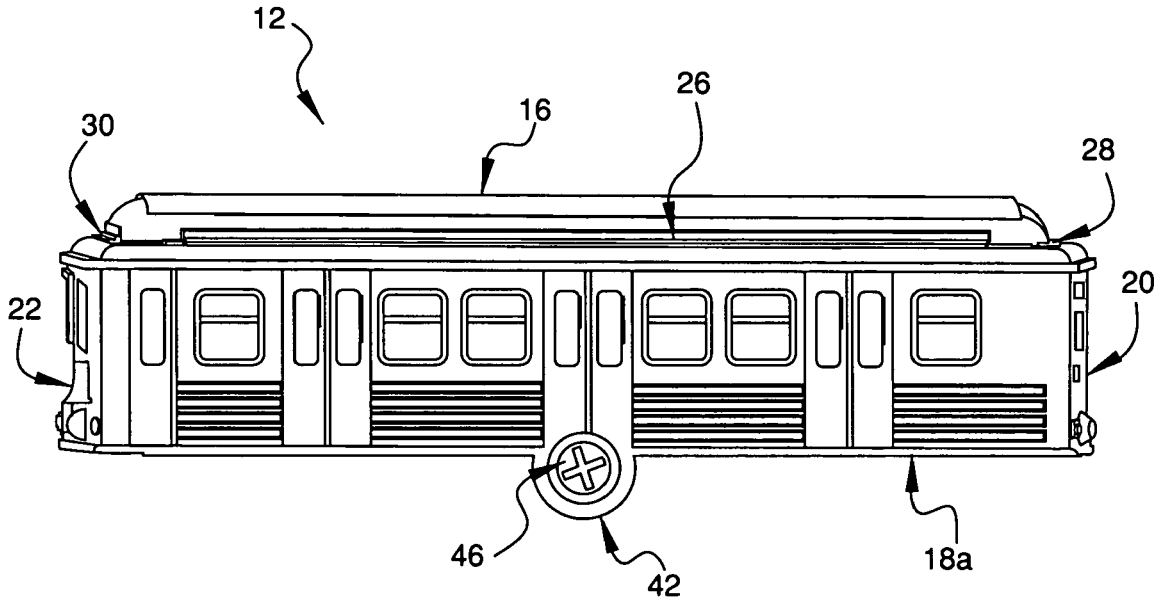
FIG. 6*a* is a side plan view of another embodiment of the folding body of a toy train according to the present invention.
Figure 6B:
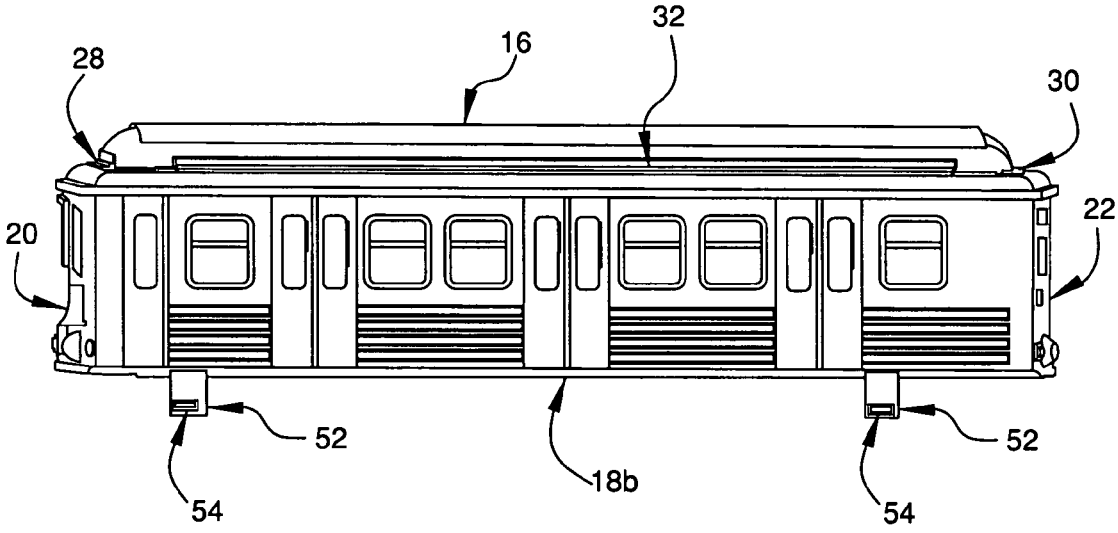
FIG. 6*b* is a side plan view of another embodiment of the folding body of a toy train according to the present invention, showing the side opposite the side shown in FIG. 6*a*.
Figure 7:
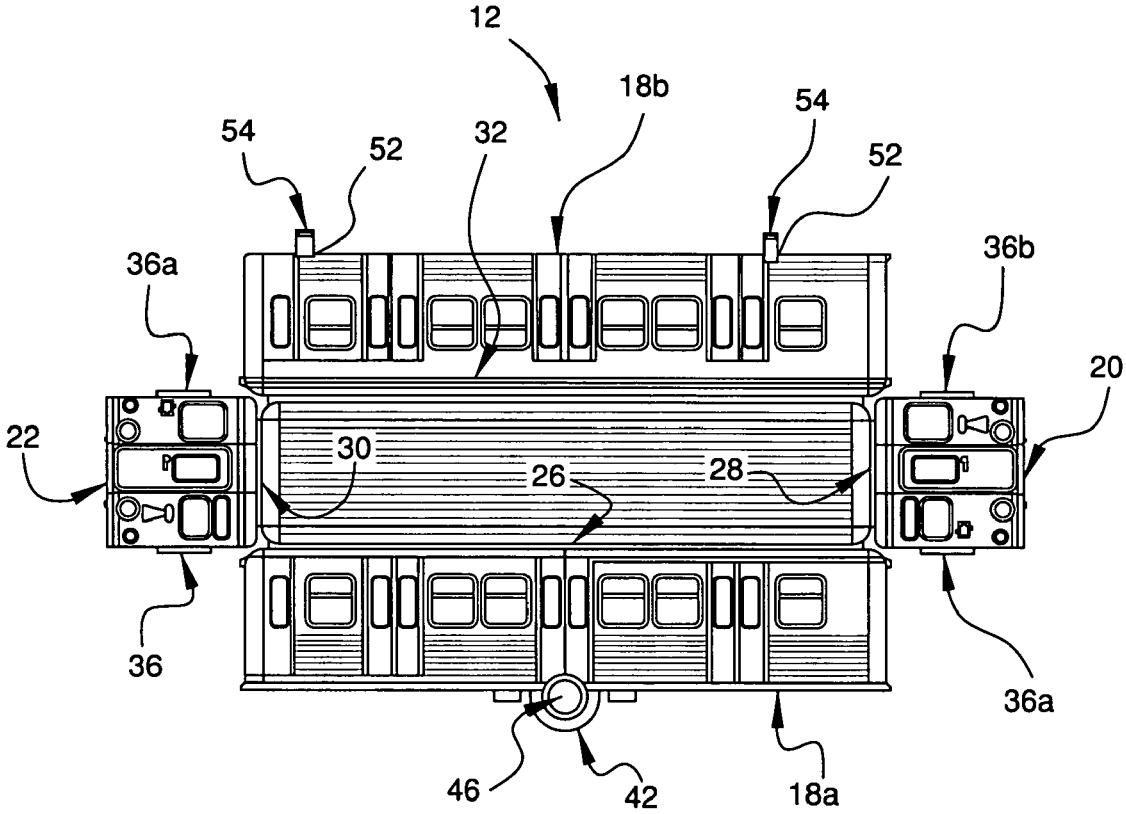
FIG. 7 is a top plan view of the embodiment of the folding body of a toy train according to the present invention shown in FIGS. 6*a* and 6*b*, shown with the folding body unfolded.
Figure 8:
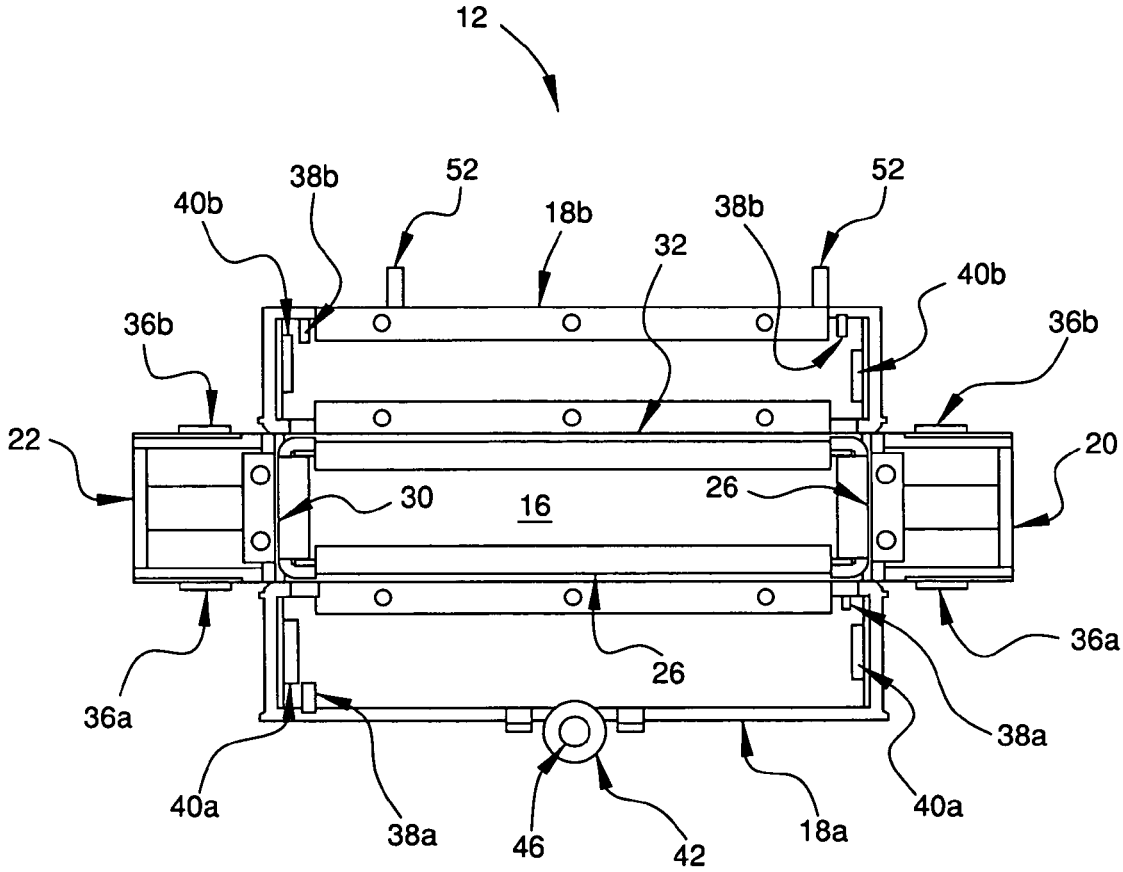
FIG. 8 is a bottom plan view of the embodiment of the folding body of a toy train according to the present invention shown in FIG. 7, shown with the folding body unfolded.

Another embodiment of the toy train according to the present invention is shown in FIGS. 6*a*, 6*b*, 7, and 8, comprising a folding body 12 that includes a central body portion 16, two side body segments 18*a* & 18*b*, a rear body segment 20, and a front body segment 22. The example of the folding body 12 of the embodiment shown in FIGS. 6-8 represents a passenger or subway-type train, although any other train types may be utilized, as discussed above.

The two side body segments 18*a* & 18*b*, rear body segment 20, and front body segment 22 are each joined to the central body portion 16 by hinges 26, 28, 30, 32, as shown in FIGS. 7 and 8. The central body portion 16, two side body segments 18*a* & 18*b*, and rear body segment 20 are arranged as described above. As shown in FIGS. 7 and 8, the front body segment 22 is formed similarly to the rear body segment 20 as described above, having projections 36*a* & 36*b* which extend from opposite sides of the rear body segment 20 adjacent the side body segments 18*a* & 18*b*. The side body segments 18*a* & 18*b* have slots 40*a* & 40*b* for removably engaging the projections 36*a* & 36*b*. In addition, side body segments 18*a* & 18*b* may have stops 38*a* & 38*b*, shown in FIG. 8, to assist in aligning the folding body 12 when the toy train is assembled. The front body segment 22 rests against the front stops 38*a* & 38*b* when the toy train is assembled. As shown in FIGS. 7 and 8, the folding body 12 may further include one or more flanges 52 extending from one of the body segments 18*a* & 18*b*, having lip 54 for securing the folding body 12 to the base 48, as described in greater detail below.

Figure 9:
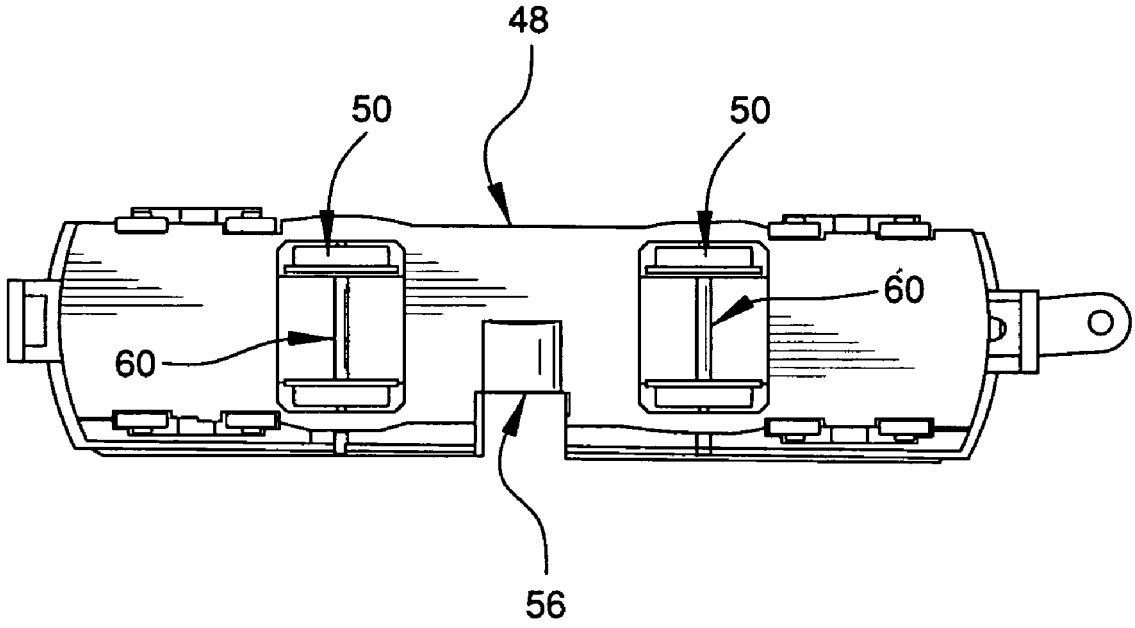
FIG. 9 is a bottom plan view of an embodiment of a base of a toy train according to the present invention.
Figure 10:
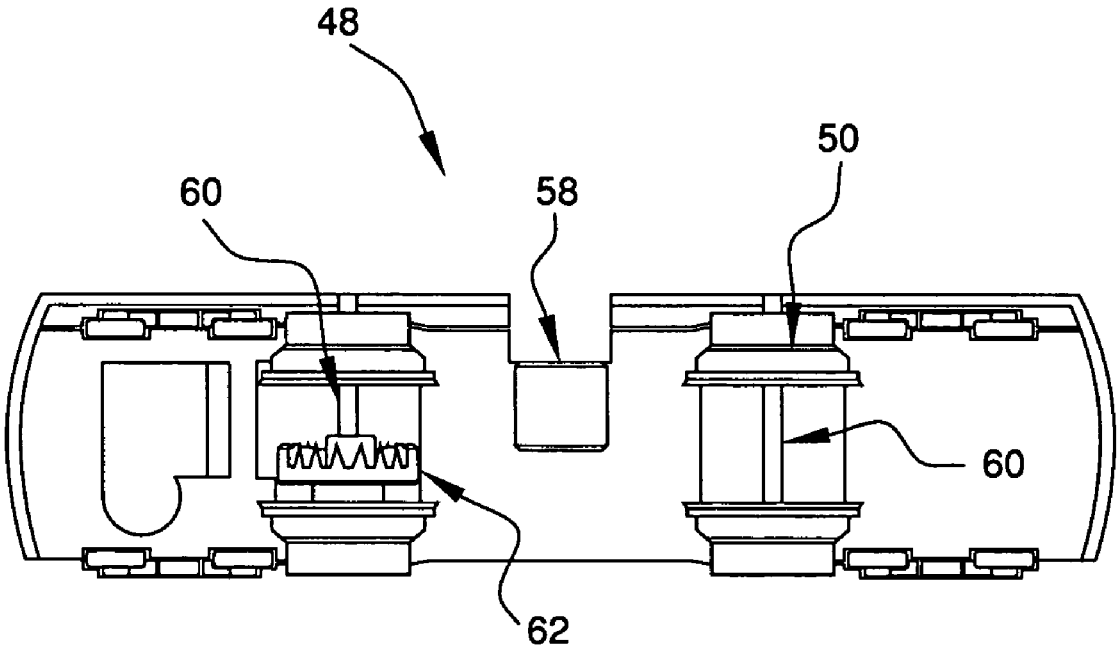
FIG. 10 is a bottom plan view of another embodiment of a base of a toy train according to the present invention.
Figure 11:
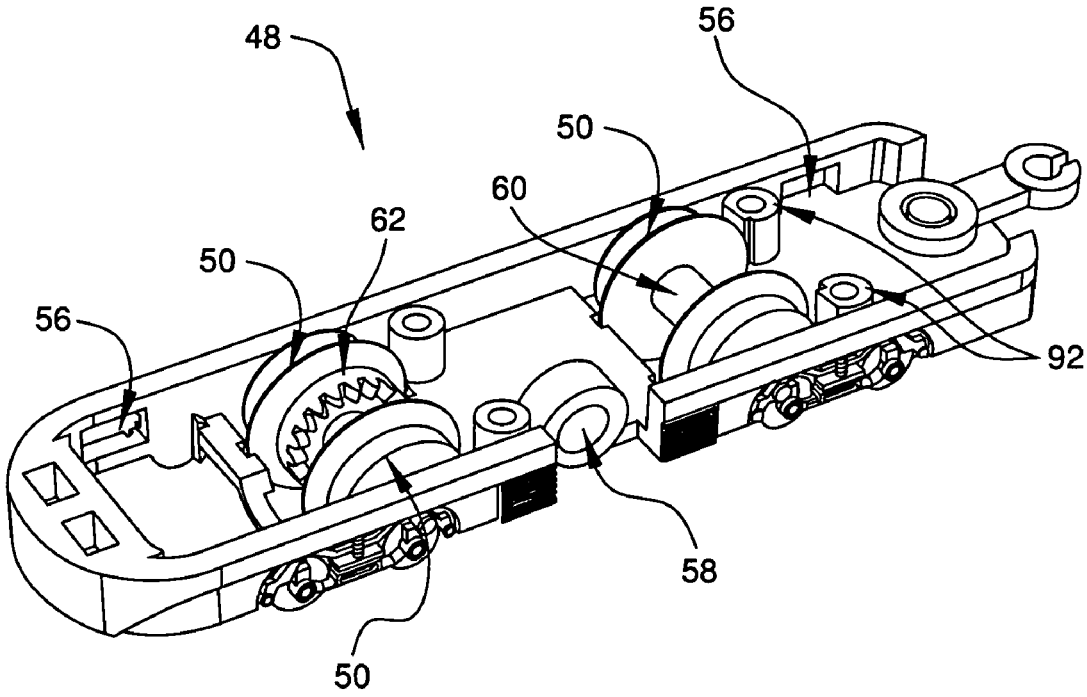
FIG. 11 is a perspective view of another embodiment of a base of a toy train according to the present invention, shown with the wheels installed

An assembled toy train 10 according to the present invention further comprises a base 48, as shown in FIGS. 9-11. The base 48 includes wheels 50 for engaging raised toy train tracks 118, which are described in greater detail below. In a preferred embodiment, the wheels are held on axles 60 connected to the base 48. The base 48 may include at least one receiving portion 56, which may take the form of a slot or opening. The receiving portion 56 is adapted to receive the flange 52 extending from a body segment 18*a*, to assist in securing the folding body 12 to the base 48. The lip 54 extends into a complementary receiving portion 56 so that the folding body 12 is removably secured to the base 48.

The embodiment of the base 48 shown in FIG. 9 is for rolling stock of the toy train set. No gear is present on the axles 60 of the base 48 shown in FIG. 9. FIGS. 10 and 11 shown different embodiments of a base 48 for use with a driver train engine or locomotive. These embodiments include gears 62 which can be driven, as described in detail below.

Figure 12:
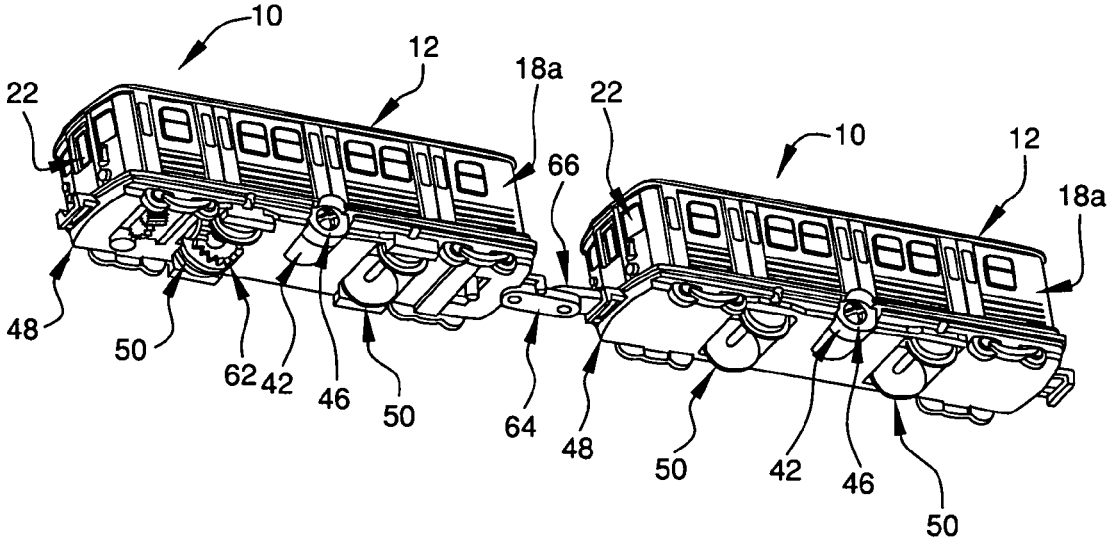
FIG. 12 is a perspective view of two assembled toy trains according to the present invention joined together by a coupler.

Additional attachments may be used to connect the folding body 12 to the base 48 for assembly. For example, as shown in FIGS. 4, 5, 6*a*, 7 and 8, the folding body 12 may have a securing portion 42 having an opening 44. A small screw 46 extends through the opening 44, as can be seen in FIGS. 6 and 7. The base 48 has a receiving portion 56 with an opening 58 which is threaded to engage the screw, as shown in FIGS. 9-11. Tightening the screw 46 in threaded opening 58 provides an additional connection to securely hold the folding body 12 on the base 48 when the toy train 10 is assembled, using only one separate fastener. FIG. 12 shows one embodiment of the toy train 10 with the folding body 12 connected to the base 48. One of the body segments 16, 18*a*, 18*b*, 20, 22, may be permanently connected to the base 48 by a living hinge. In that case, the toy train 12 could still be disassembled by disengaging the other of the body segments that are not connected to the base by a hinge.

The base 48 of a toy train according to the present invention may further include a coupler 64 for engaging another toy train in the set, as shown in FIG. 12. The base 48 of a separate toy train may include a mating coupler 66 for engaging the coupler 64. Thus, several toy trains in a toy train set can be attached together, with an engine pulling rolling stock.

The base 48 is preferably molded from a polymeric material, such as a moldable plastic. Other materials may be used. The wheels 50 and axles 60 can be formed from metallic or polymeric materials. The gear 62 is preferably formed from a polymeric material.

Figure 13:
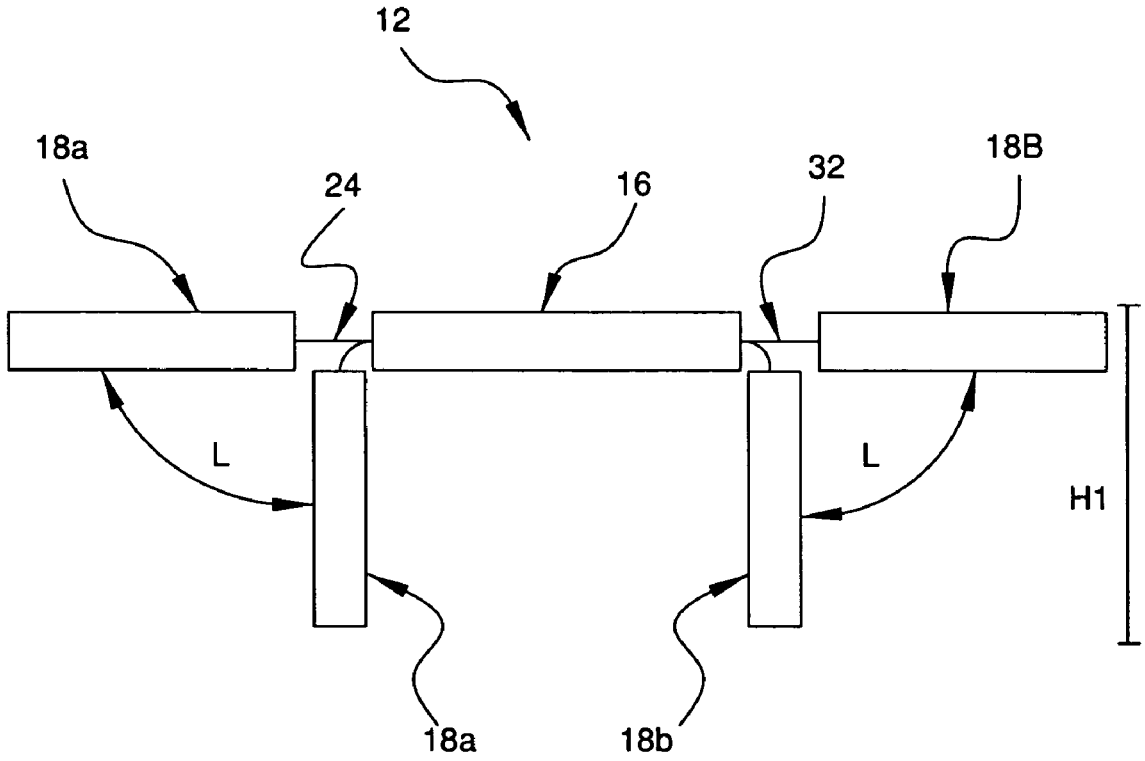
FIG. 13 is a schematically illustrated cross sectional view of the folding body of a toy train according to the present invention showing the folding body transitioning between the unfolded state to a folded state for assembly.

A unique feature of the toy train 10 of the present invention is that the folding body 12 can be generally flattened when disassembled, for convenient storage in, for example, a storage case, as will be described in greater detail below. As used herein, the term "generally flattened" refers to a position where the profile of the folding body 12 is reduced for storage, such as any position wherein the body segments of the toy train according to the present invention are moved from an assembled position away from each other, creating a decreased or flattened, as compared to the assembled arrangement, profile. For example, shown in FIG. 13 is a cross-sectional view from the front of a toy train according to the present invention, showing a central body segment 16 attached by hinges 24, 32 to side body segments 18*a* & 18*b*. In one position, FIG. 13 shows the toy train in an assembled position, with side body segments 18*a* & 18*b* generally vertical, and with the folding body 12 having a height H1. FIG. 13 further shows the range of motion, illustrated by the curved lines L, through which the side body segments 18*a* & 18*b* can move relative to the central body segment 16 during unfolding for disassembly. Similarly, front body segment 22 and rear body segment 20 can be moved away from central body segment 16, flattening the profile of the folding body 12.

Figure 14:
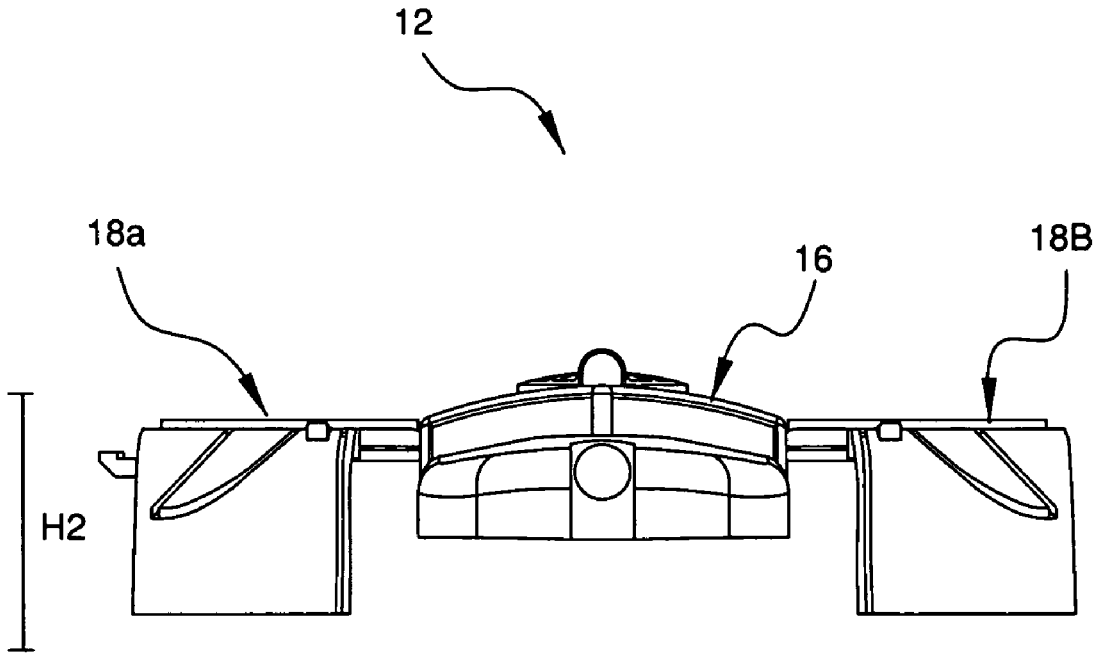
FIG. 14 is a front plan view of an embodiment of the folding body of the present invention shown in a generally unfolded or flattened arrangement.
Figure 15:
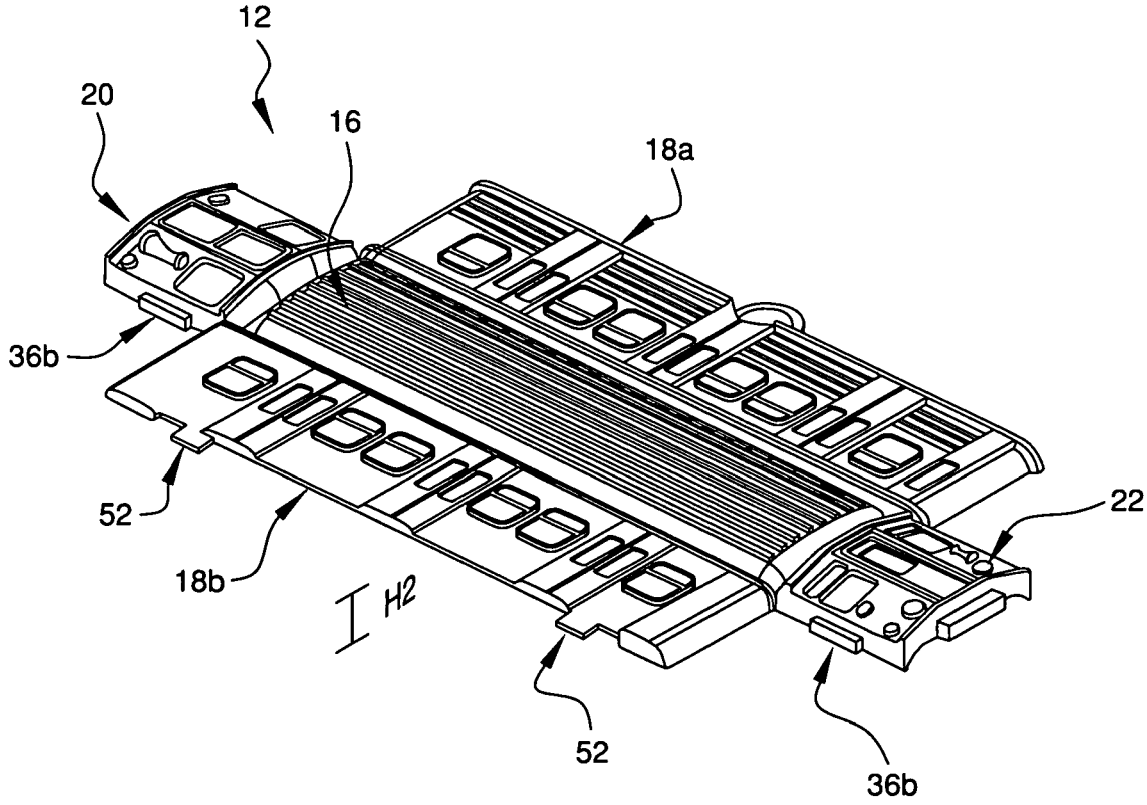
FIG. 15 is a perspective view of another embodiment of the folding body of the present invention shown in a generally unfolded or flattened arrangement.
Figure 16:
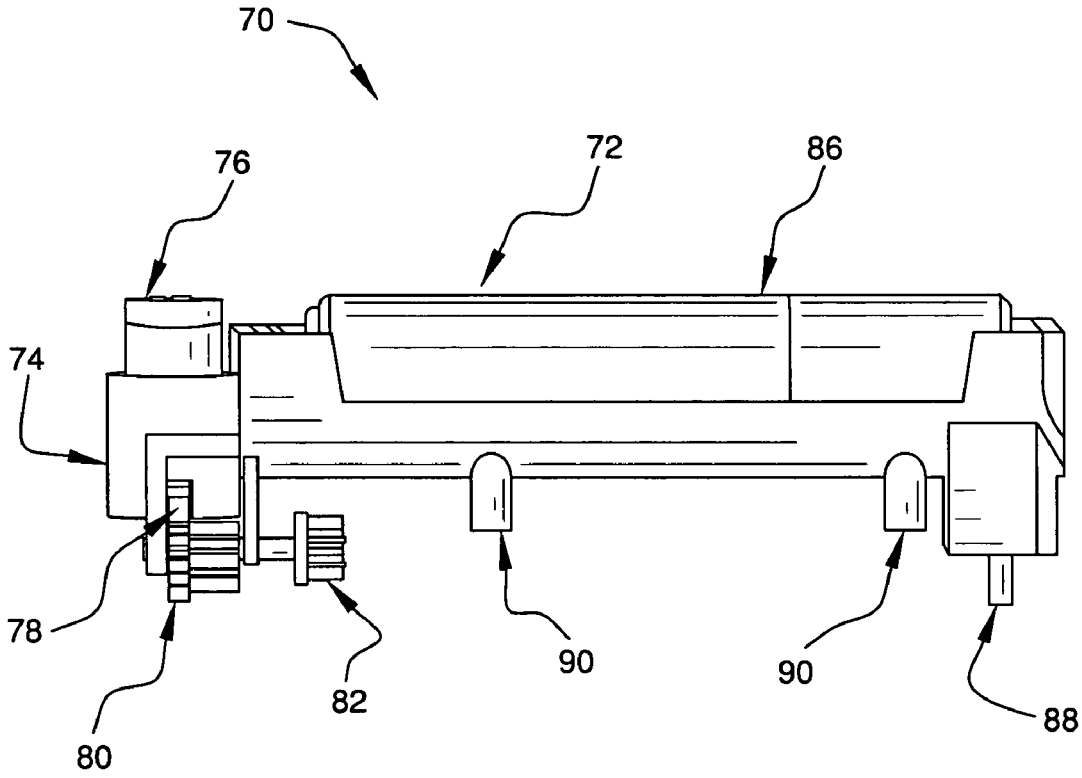
FIG. 16 is a side plan view of a drive assembly according to the present invention.
Figure 17:
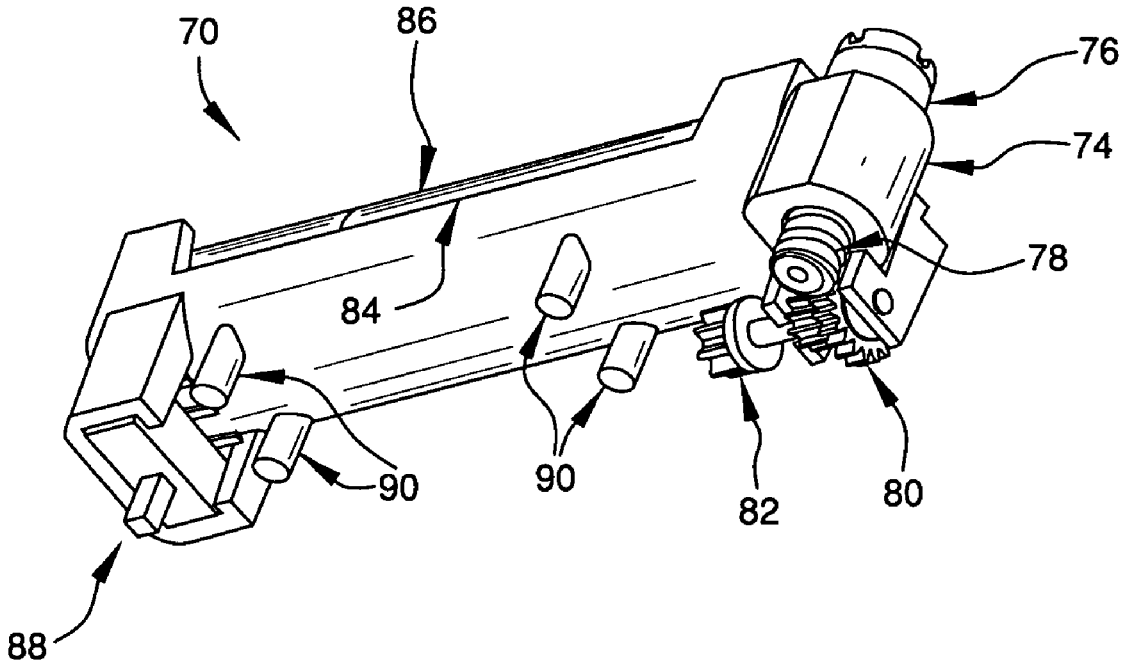
FIG. 17 is a bottom perspective view of the drive assembly for use in a toy train according to the present invention shown in FIG. 16.

The side body segments 18*a* & 18*b* can be moved away from the central body segment 16 on their respective hinges 24, 32, when the toy train is unfolded for disassembly, such as for storage. In this way, the folding body 12 is generally flattened. This is shown in FIGS. 14 and 15, with the folding body 12 in the generally flattened position for two embodiments of the folding body 12, having a height designated as H2 in the disassembled position. The height H2 in the generally flattened position is less than H1. In a preferred embodiment, shown in FIGS. 14 and 15, the different body segments of a given folding body lie substantially flat when the train is completely disassembled. It is appreciated that the side body segments, or rear body segment, or front body segment, may be angled slightly from the plane of the central body segment, and such an arrangement would still be considered to be a "generally flattened arrangement" as that term is used herein.

Where a particular toy train will be used as, for example, an engine or locomotive, the present invention provides a novel drive assembly 70, as shown in FIGS. 16-17. The drive assembly 70 is sized to fit within the folding body 12 of the toy train 10 when the toy train 10 is in an assembled position. The drive assembly 70 comprises a drive mechanism 74 for providing the motive force for driving at least one of the wheels 50 of the toy train according to the present invention. The drive mechanism 74 comprises a motor 76, which turns a cylindrical worm 78. The cylindrical worm 78 turns a gear 80 attached to the drive assembly 70. Although in this example a worm gear is shown, it is appreciated that any mechanical gear may be substituted without departing from the present invention, so long as motor 76 turns a gear such as gear 80, which has a driving gear 82.

Figure 18A:
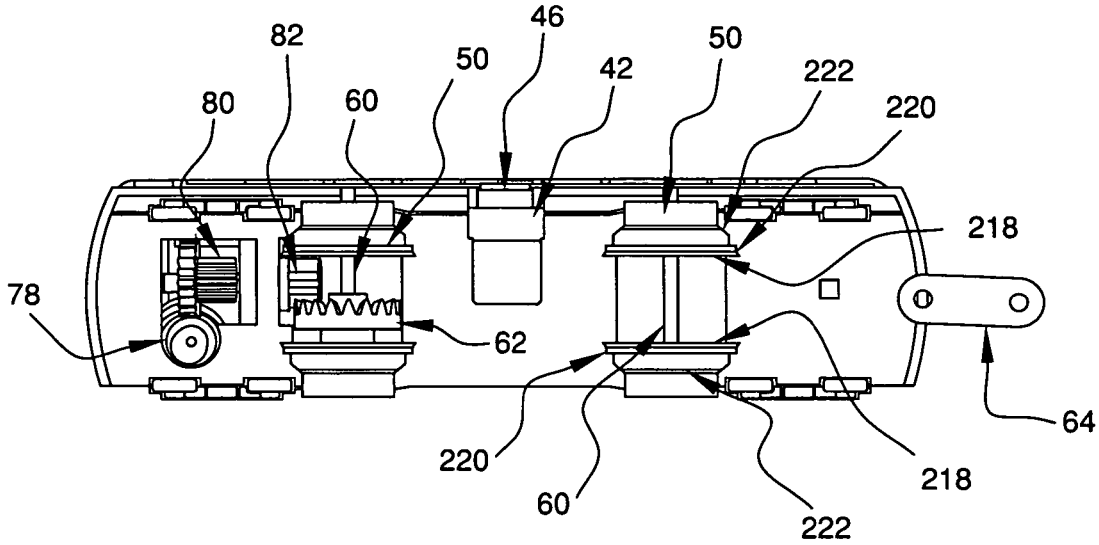
FIG. 18*a* is a bottom plan view of a toy train according to the present invention assembled with the drive assembly in the base.
Figure 18B:
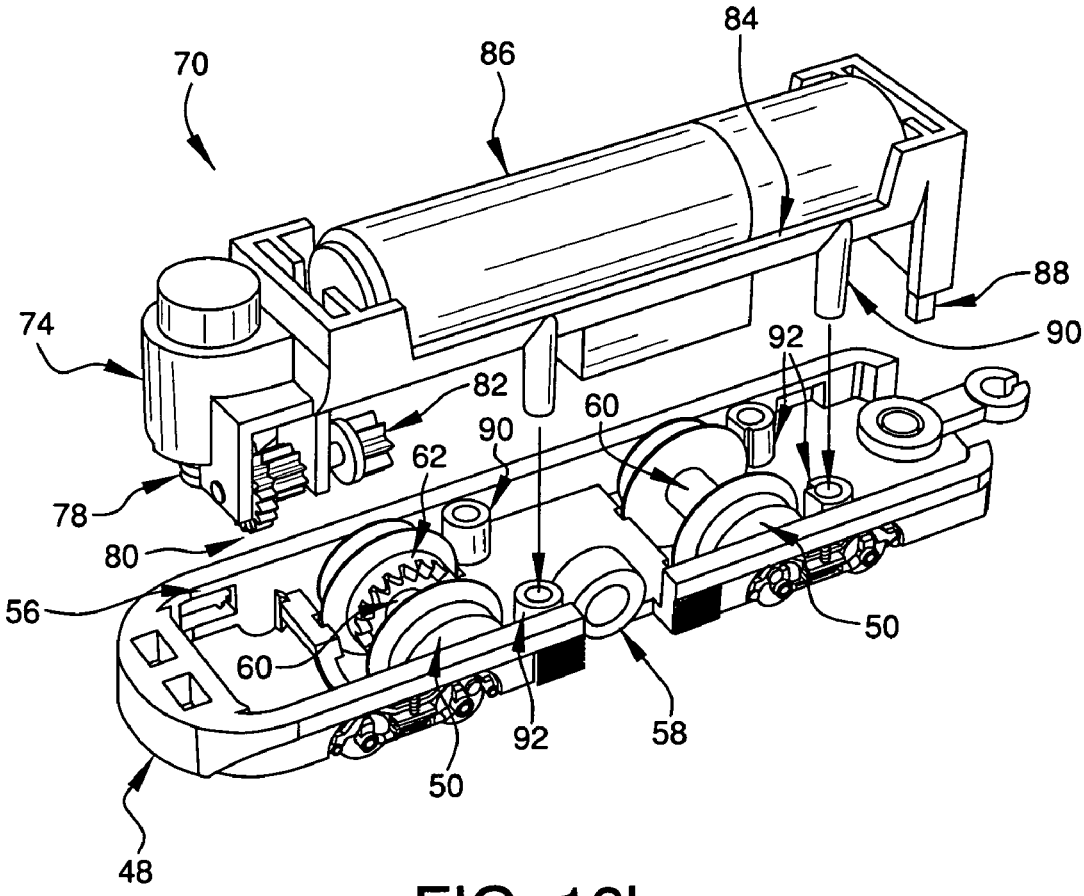
FIG. 18*b* is a top perspective view showing assembly of the drive assembly shown in 18*a* with an embodiment of the base of a toy train shown in FIG. 11.

In order to engage the driving gear 82 of the drive assembly 70, a gear 62 is provided on an axle 60 of one of the sets of wheels 50, as shown in FIGS. 10 and 18. When assembled, the driving gear 82 of the drive mechanism 74 engages the gear 62 on the axle 60. When the motor 76 of the drive mechanism 74 turns gear 80, gear 80 will turn gear 62, thus turning the axle 60 and driving the toy train engine.

The drive assembly 70 further comprises a power source 72, as shown in FIGS. 16 and 17. The drive mechanism 74 may be powered mechanically, such as by a wind-up spring (not pictured), or may be powered by a battery 86. Where a battery 86 is used, the drive assembly 70 further includes a holding portion 84 for receiving the battery 86.

Connection posts 90 are preferably provided on a surface of the drive assembly 70 for engaging the base 48. The base 48 preferably includes complementary receiving openings 92, as shown in FIG. 11, for frictionally engaging the connection posts 90 when the toy train is assembled. When assembled, the drive assembly 70 sits inside the folding body 12, and powers the toy train 10 representing the engine.

A switch 88 for turning on the power source moveable between an "ON" and "OFF" position may also be provided as part of the drive assembly 70. The body segments 14 of the folding body 12 are preferably formed to accommodate the switch 88, so that the switch is accessible when the train is assembled. It is appreciated that the switch 88 can be positioned on any surface of the drive assembly 70, such as on the side or end of the drive assembly 70.

Figure 19A:
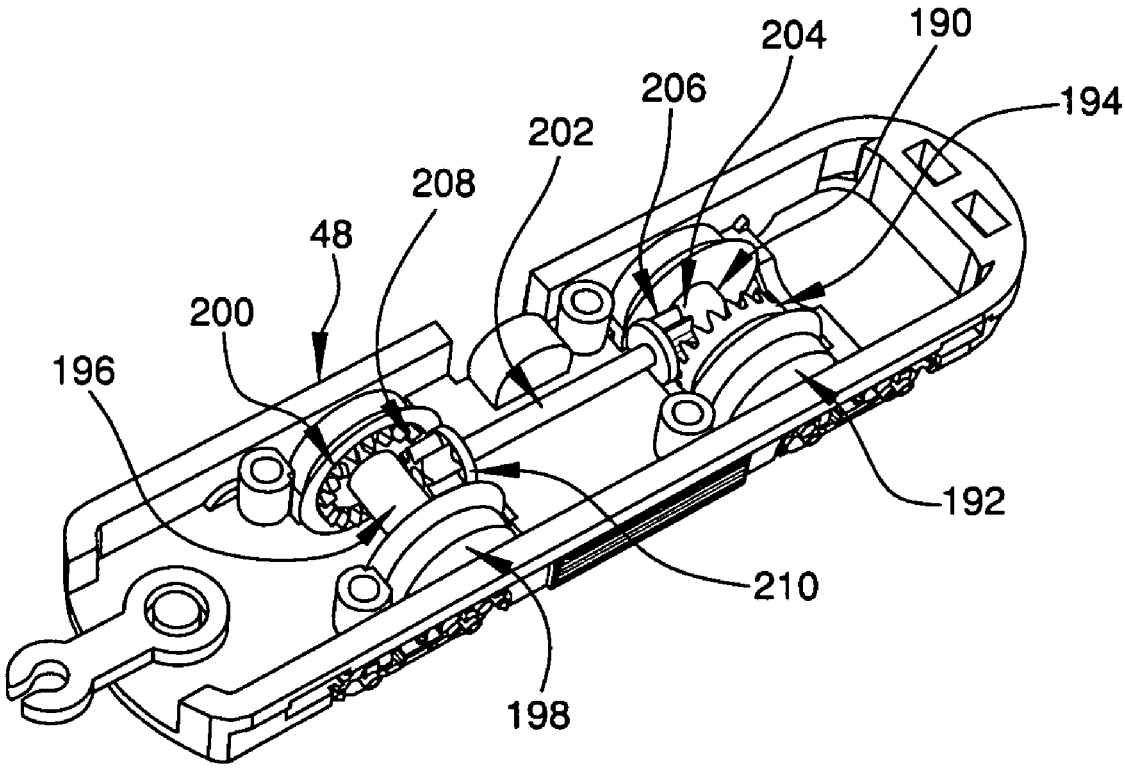
FIG. 19*a* is a perspective view of the inner side of the bottom of a toy train according to the present invention with a four wheel drive assembly arrangement.
Figure 19B:
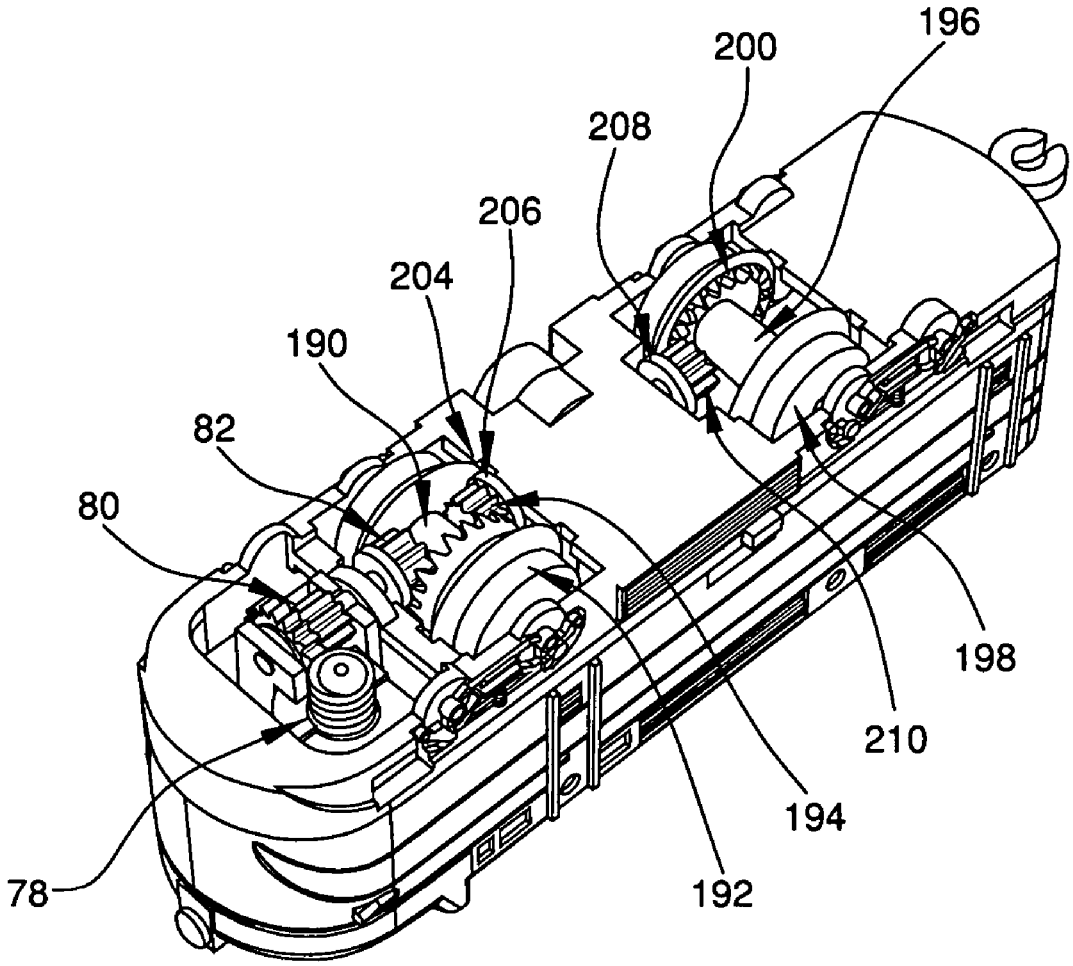
FIG. 19*b* is a perspective view of the bottom of an assembled toy train according to the present invention having a four wheel drive assembly arrangement.

A version of the toy train 10 of the present invention where two axles located in the base 48 are operated by the drive assembly is shown in FIGS. 19*a* and 19*b*. The base 48 has a first axle 190 having wheels 192, and a first gear 194 for engaging the drive gear 82 of the drive mechanism 74 of the drive assembly 70. A second axle 196 has wheels 198 and a second gear 200. A drive shaft 202 is provided extending between the first gear 194 and the second gear 200. The drive shaft 202 has a first end 204 having a first gear 206 for engaging the first gear 194 of the base 48, and a second end 208 having a second gear 210 for engaging the second gear 200 of the base 48. In operation, the drive mechanism 74 will turn, for example, the first gear 194 of the first axle 190. The first gear 194 of the first axle 190 will turn the first gear 206 of the drive shaft 202, thus turning the post 202 and the second gear 210 of the post. The second gear 210 of the drive shaft 202 will turn the second gear 200 of the second axle 196, thus providing an "all wheel drive" toy train. The drive shaft 202 is mounted for rotational movement on the base 48. It is appreciated that other arrangements for translating the movement of the drive mechanism 74 from the first axle 190 to the second axle 196, such as a rack and pinion gear arrangement, or other known gear arrangements, may be employed to accomplish simultaneously moving all of the wheels of the toy train according to the present invention.

Figure 20A:
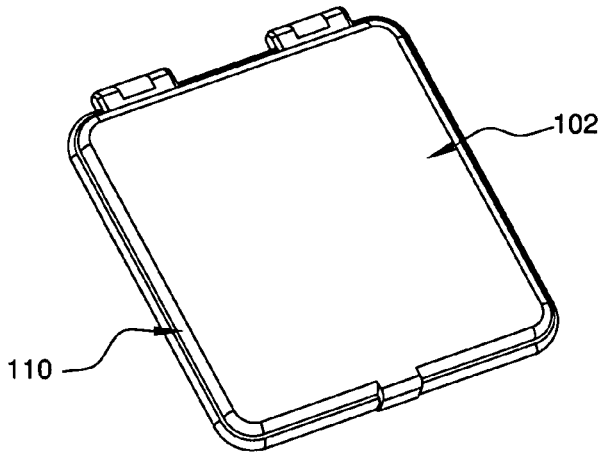
FIG. 20*a-e* show various perspective views of a toy train storage kit according to the present invention.
Figure 20C:
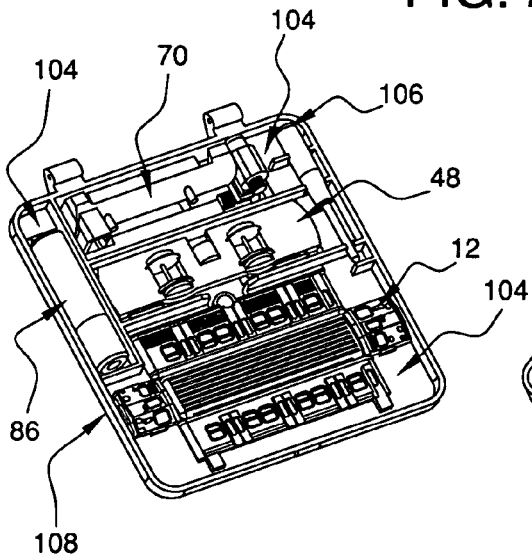
Figure 20B:
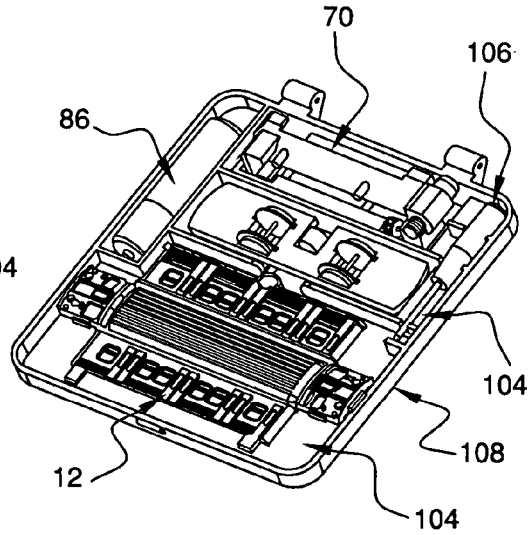
Figure 20E:
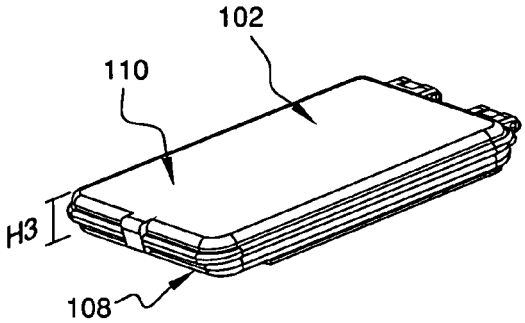
Figure 20D:
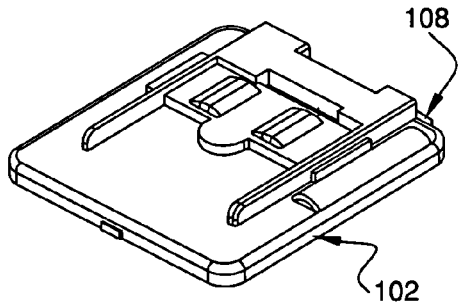

The present invention is also directed to a complete toy train storage kit 100, as shown in FIGS. 20*a-e*. A storage case 102 is provided having several recesses 104 sized to receive the different elements of a toy train discussed herein. When the toy train 10 is disassembled, as shown in FIGS. 20*b* & 20*c*, the base 48 and drive assembly 70 are placed in recesses 104. The folding body 12 is disassembled to a generally flattened arrangement and placed in one of the recesses 104 sized to accommodate the folding body 12.

Other accessories or items may be included in the kit 100. For example, as shown in FIG. 20*b*, a tool such as a screwdriver 106 may be included for securing the folding body 12 to the base 48. A recess 104 is provided for holding the tool 106 in the kit 100. Battery 86 may also be held within a sized recess 104 in the storage case 102. An accessory for a toy train may also be provided as part of the kit, such as, for example, scenery details such as signs, plastic pieces formed in the shape of buildings, or any other accessory that may increase the play value of a toy train set. The kit 100 provides a compact way to store the toy train and any tools or accessories, and also provides an incentive to put the toy train away after play.

The storage case 102 preferably includes a cover 110 shown in FIGS. 20*a* and 20*c*, but may comprise only the tray 108, having recesses 104. Where a cover 110 is provided, the height H3 of the storage case 102 when closed is sized to accommodate the different parts of the toy train 10 when they are disassembled, and is less than the height H1 of the folding body 12 when the folding body 12 is in an assembled arrangement.

The present invention is also directed to an expandable toy train set 120, as shown in FIGS. 21-25. The expandable toy train set 120 provides for an easy and fin way to build a toy train set without the need for any complicated attachments or tools. In addition, the toy train set 120 is modular, and offers many layouts utilizing different arrangements of the same pieces to increase play value.

Figure 21A:
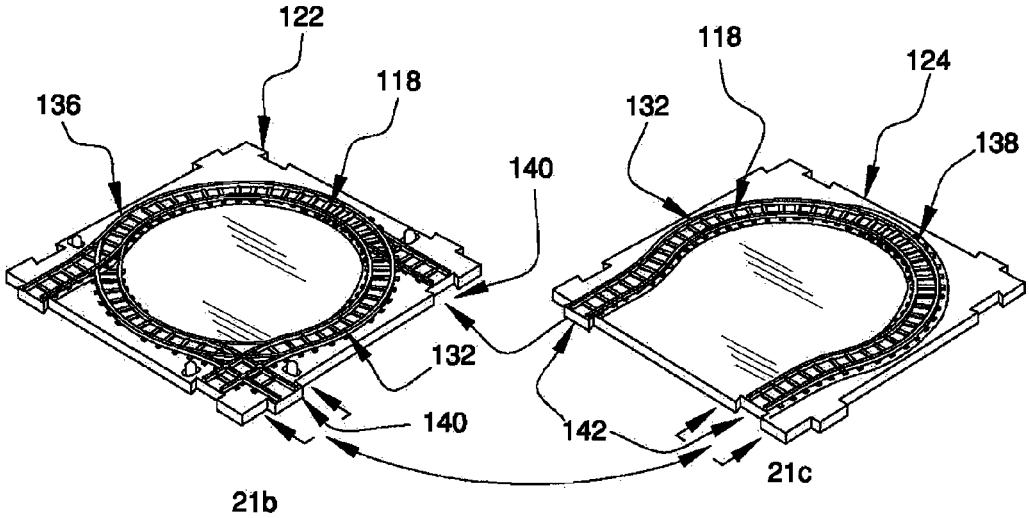
FIG. 21*a* shows a perspective view of two tiles of a toy train set according to the present invention.

A first tile 122 is shown in detail in FIG. 21*a* having a first configuration 136 of toy train tracks 118. By way of example, different configurations of tracks may include, but are not limited to, straight aways, 4-way intersections, 90 degree turnarounds with 4-way switchers (shown in FIG. 21*a*), crossovers, and 180 degree turnarounds (also shown in FIG. 21*a*).

The toy train tracks 118 comprise parallel elevated rails 132 integrally molded or otherwise formed on a tile 122, 124 resembling "real" train tracks. The wheels 50 of the toy train 10 of the present invention are designed to engage the elevated rails 132, as shown in FIG. 18, with flanges 218 formed on the inner portion 220 of each wheel. When the toy train 10 is aligned with the toy train tracks 118, the riding portion 222 of the wheels 50 are positioned to ride on the elevated rails 132, and the flanges 218 are positioned between parallel elevated rails 132, in order to align, guide and keep the toy train 10 on the tracks during play. In addition, for toy train engines or locomotives that have a drive assembly 70, as discussed above, the riding portion 222 of the wheels 50 may be formed from or coated with a rubberized or elastic material, forming a gripping tread for at least one of the wheels 50.

Figure 22:
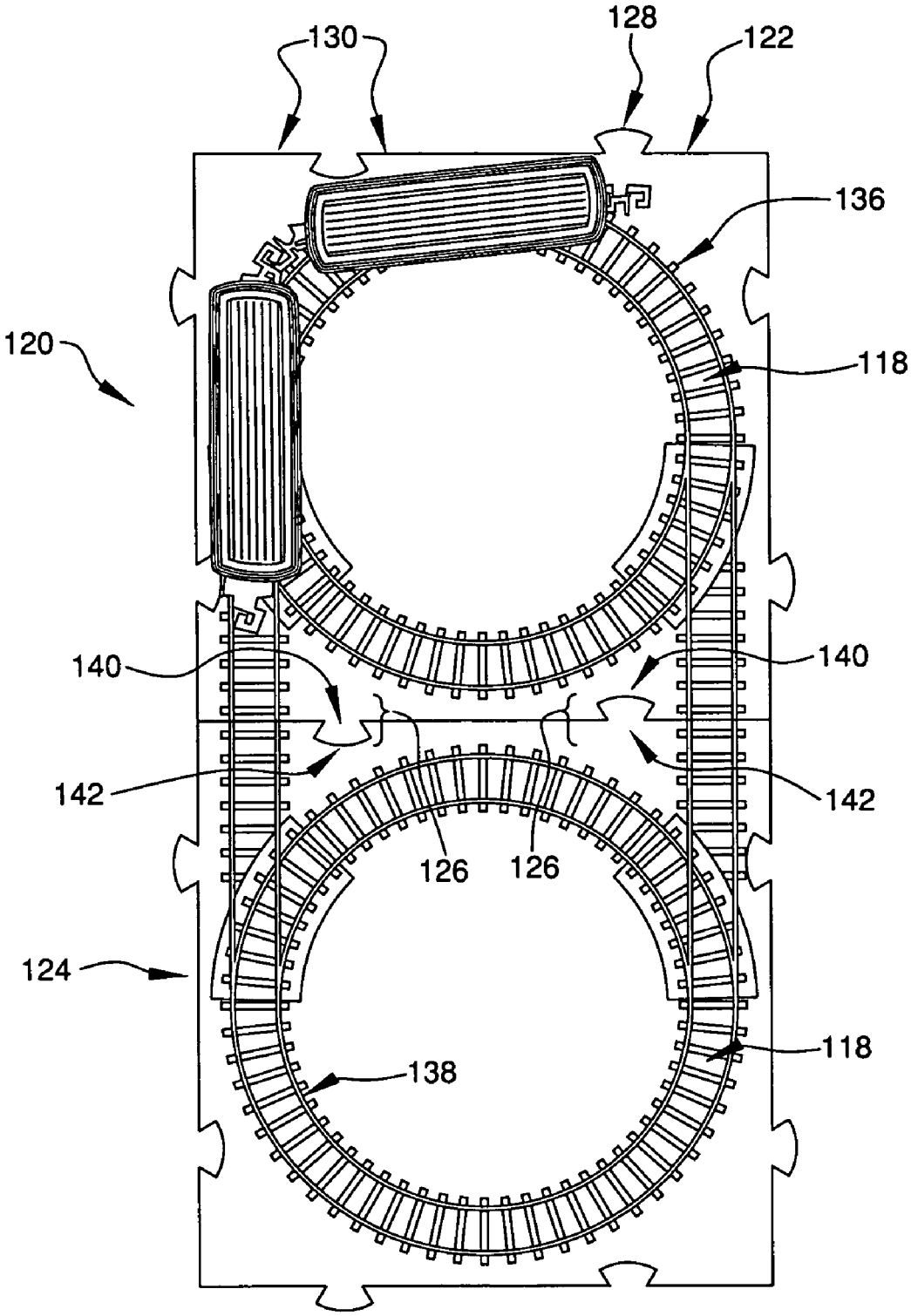
FIG. 22 shows a top plan view of two tiles of a toy train set according to the present invention joined together.

A second tile 124 is provided having a second configuration 138 of toy train tracks 118, as shown in FIGS. 21*a* and 22. The first tile 122 has a first alignable portion 140 that aligns with a second alignable portion 142 of the second tile 124. In a preferred embodiment, the alignable portions 140, 142 comprise corresponding segments of train tracks, whereby when the alignable portions 140, 142 are aligned, a continuous train track assembly is formed, as shown in FIG. 22.

The first tile 122 and second tile 124 are joined by at least one dovetail joint 126. As shown in FIGS. 21*a* and 22, in a preferred embodiment, the first tile 122 has sets of tails 130 and pin 128, while the second tile 124 has corresponding pins 128 and tails 130. In a preferred embodiment shown in FIG. 22, the pins 130 and tail 128 are adjacent the alignable portions 140, 142. Connection of the first tile 122 and the second tile 124 via the dovetail joints 126 aligns the alignable portions 140, 142, creating a continuous toy train track.

Figure 21B:
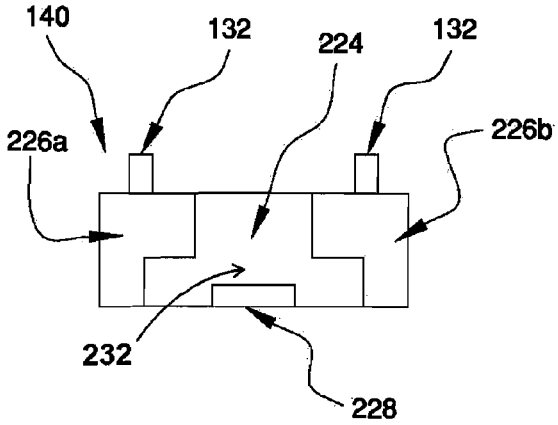
FIG. 21*b* shows an enlarged end view of the track connector of a tile of a toy train track according to the present invention, showing the male connector part.
Figure 21C:
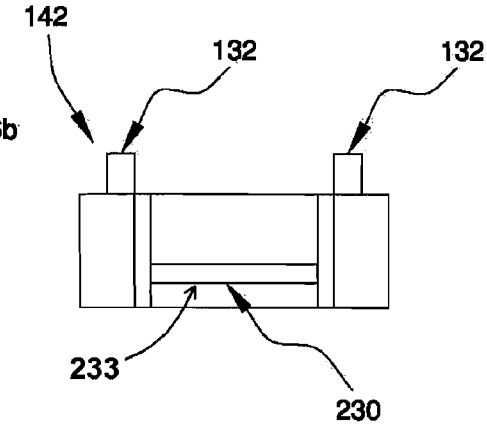
FIG. 21*c* shows an enlarged end view of the track connector of a tile of a toy train track according to the present invention, showing the female connector part.

In a preferred embodiment, shown in FIGS. 21*b* and 21*c*, a first height alignment portion 232 and a second height alignment portion 233 are included for maintaining the train tracks 118 level and continuous when the tiles 122, 124 are assembled. The first alignable portion 140 includes a recessed center portion 224 with upper protruding shoulders 226*a* & 226*b*, and a lower center protrusion 228, as shown in 21*b*. A second alignable portion 142, shown in detail in FIG. 21*c*, includes an intermediate projection 230, adapted to be received by the recessed center portion 224, and nested between the upper protruding shoulders 226*a* & 226*b* and the lower center protrusion 228. This arrangement provides an additional means for aligning the first tile 122 and second tile 124, and for aligning the height of the elevated rails 132, so that the toy train track 118 is continuous.

Figure 23:
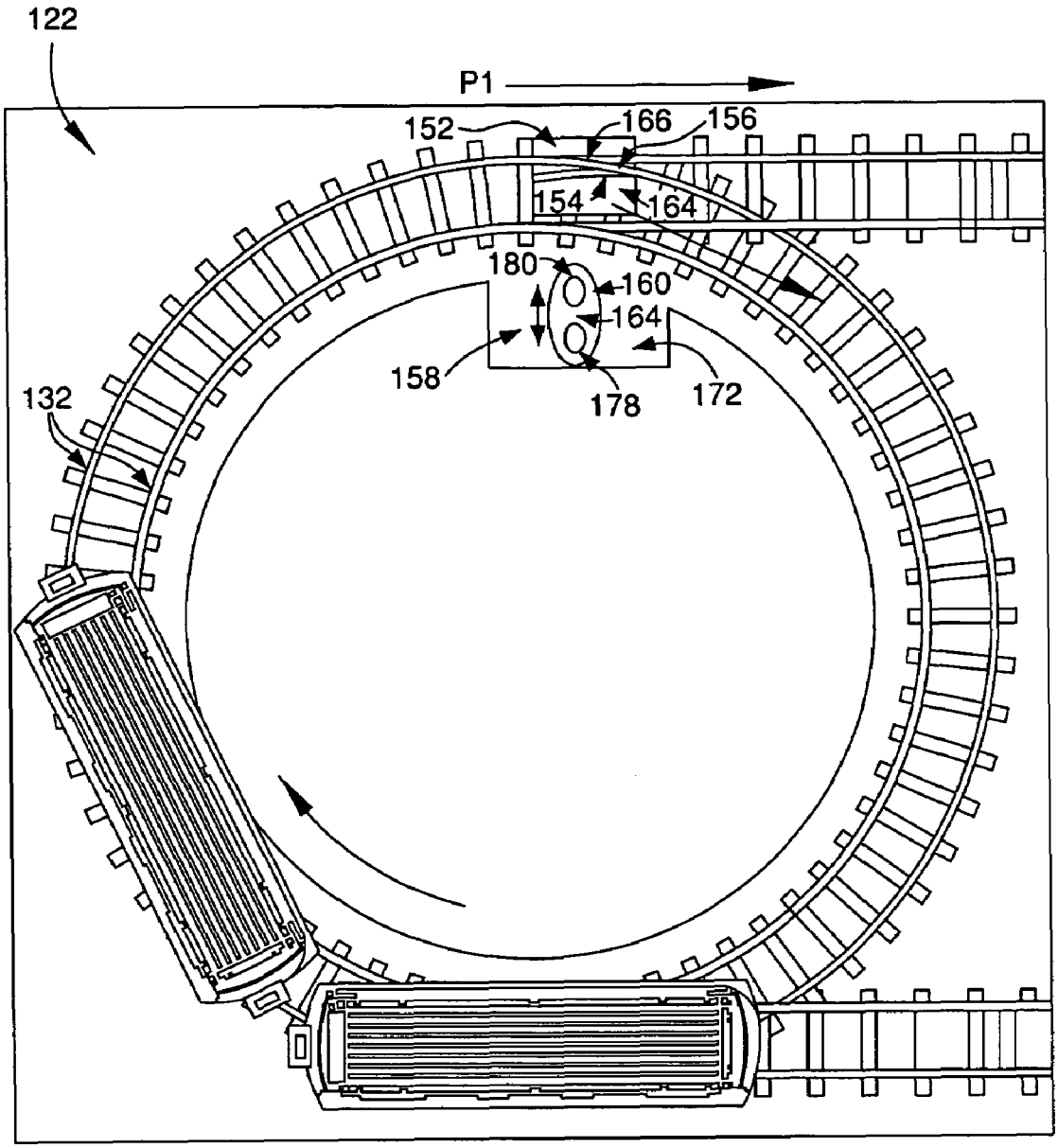
FIG. 23 shows a tile of a toy train set according to the present invention having a moveable track section.

The elevated rails 132 of the tiles may be equipped with a moveable section or switch 152, as shown in FIG. 23. In a preferred embodiment, the moveable section 152 comprises a section of elevated rail 166 that can move, preferably by pivoting, from a first position 154, to a second position 156. In the first position 154, a toy train traveling along the elevated rail 132 in the direction of the arrow in FIG. 23 will continue along path P1. In the second position 156, a toy train traveling along the elevated rail 132 in the direction of the arrow in FIG. 23 will continue along path P2.

The moveable section 152 may be moved between the first position 154 and the second position 156 by an actuator 158. The actuator 158 is formed as a projection attached to the moveable section 152. In a preferred embodiment shown in FIG. 23, moveable section 152 has an actuator 158 in the form of button 160 connected to a section of elevated rail 166 extending from an upper side of the moveable section 152. Button 160 and section of elevated rail 166 extend through openings 164 in a tile 172, so that they can be accessed by a user from the upper side of a tile 172. Moving button 160 from a first position 178 to a second position 180 will in turn move section of elevated rail 166 from a first position 154 to a second position 156. In this manner, a user may divert the path of a toy train riding on the tracks of the expandable toy train set of the present invention.

Figure 24:
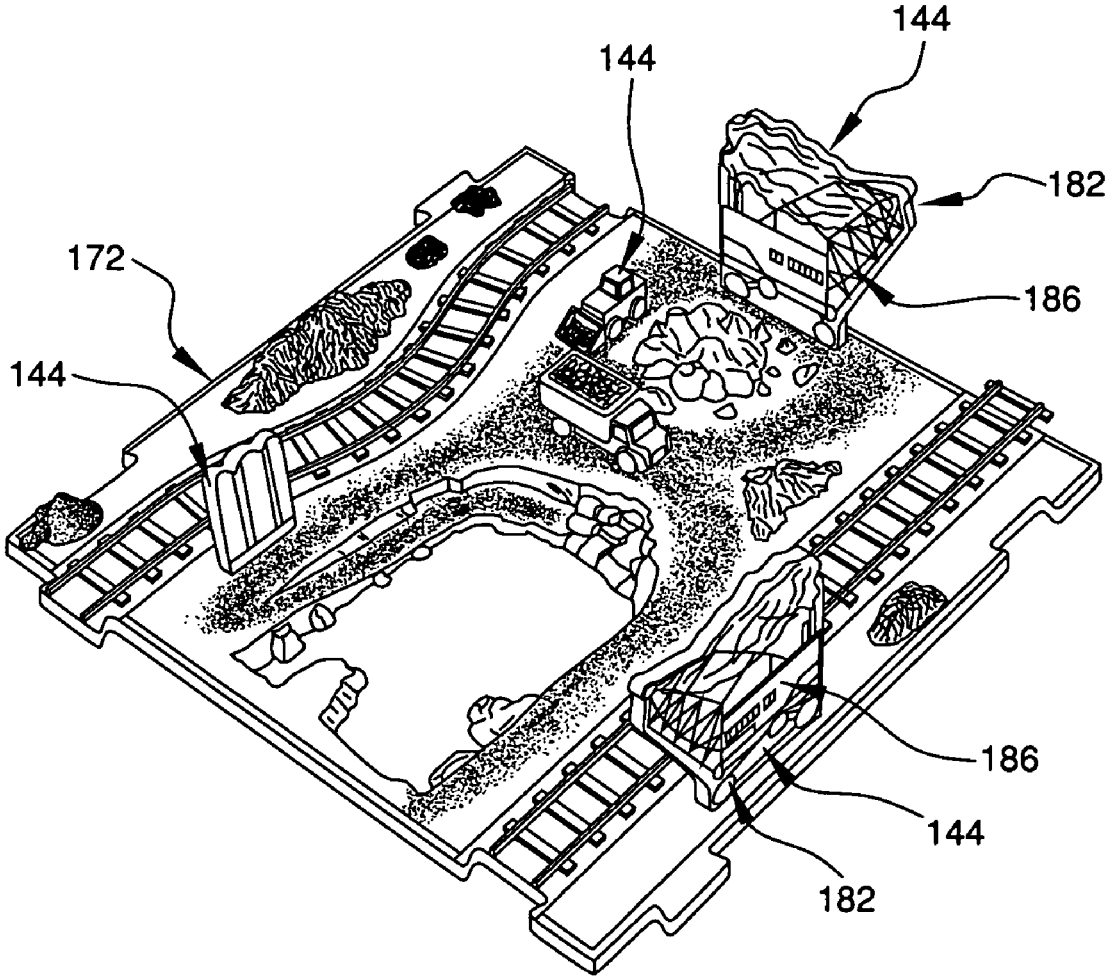
FIG. 24 shows a perspective view of a tile of a toy train set according to the present invention having various accessories.
Figure 25:
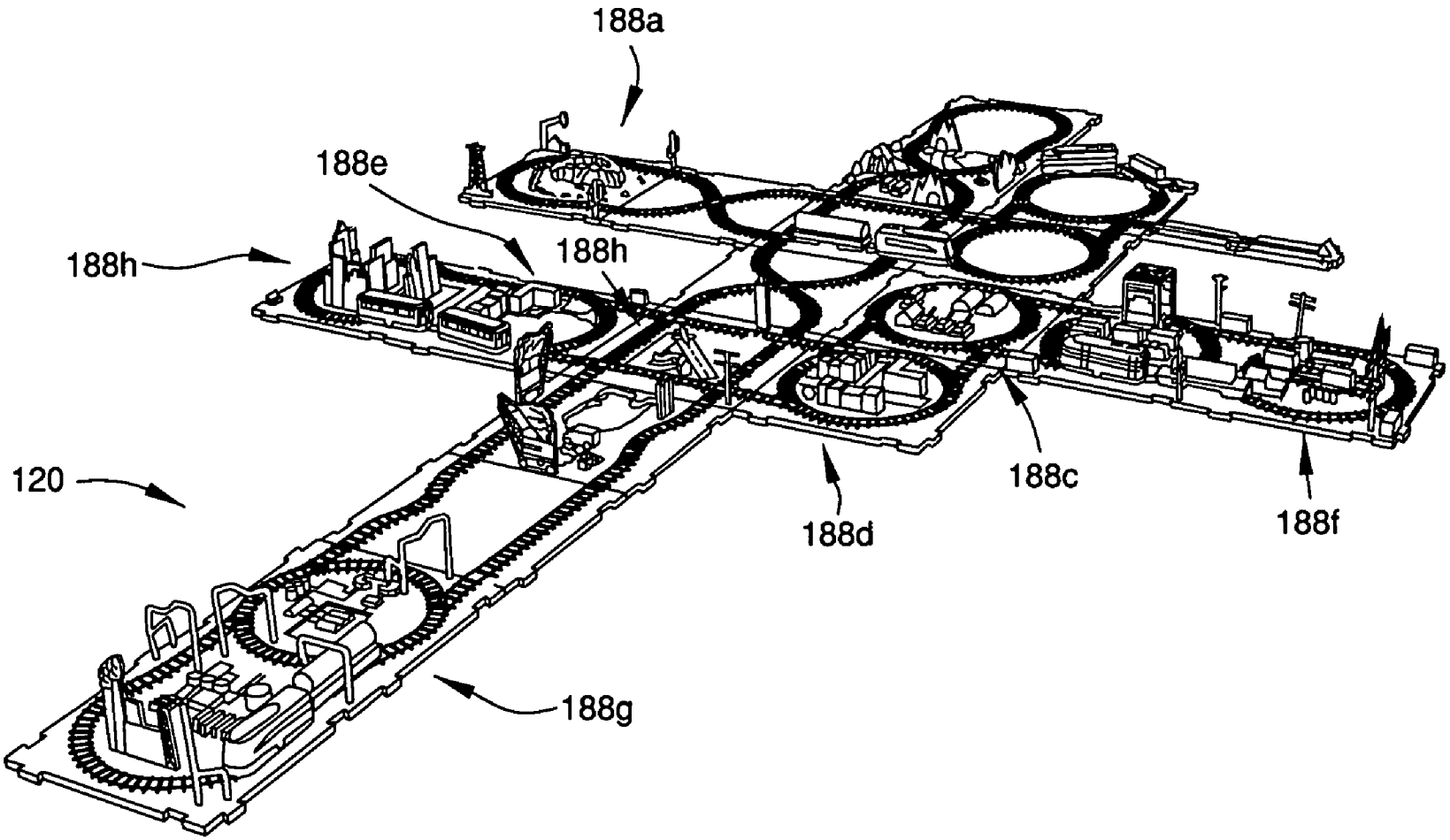
FIG. 25 shows a perspective view collection of themed tiles of a toy train set according to the present invention having various accessories.

Additional tiles may be provided, having various train track configurations, as shown in FIGS. 24 and 25. Each tile may be formed according to the descriptions of the first tile 122 and second tile 124 described above, having toy train tracks 118 with elevated rails 132, as well as dovetail joints 126 for adding to the expandable toy train set 120 of the present invention. Tails and pins of dovetail joints may be provided on two or more sides of a given tile 172, as shown in FIGS. 24 and 25, so that additional tiles may be joined on any or all sides, creating a highly variable expandable toy train set. Because the tiles 172 are held together by dovetail joints, there is no need for additional means to maintain the tiles together, so assembly and disassembly of the train set 120 is simple.

At least one of the tiles 172 of the expandable toy train set 120 of the present invention may have a play accessory 144 for a toy train set, such as a building, tree, vehicle, gate, sign, or other item that may increase the play value of the toy train set, as shown in FIG. 24. The play accessory 144 may take several forms. For example, the play accessory 144 may take the form of a plastic insert 182 having at least one peg. The plastic insert 182 may be flat, or may have a three dimensional shape. In a preferred embodiment, a plastic insert 182 is flat, as shown in FIG. 24. A portion for engaging the tile 172 is formed on an edge of the plastic insert 182, that may be inserted into an indentation or opening in the tile 172 in an assembled position. Stickers 186 may be provided for decorating the plastic insert 182. The stickers 186 may include graphics or other indicia.

At least one of the tile 172 may be a themed tile having themed scenery details 150, as shown in FIGS. 24 and 25. As used herein, a "themed tile" is a tile having pre-formed details which create a particular motif. A themed tile has a collection of pre-formed details creating a unitary motif, such as, for example, buildings, landscape details, signage, settings, landmarks, vehicles, roadways, airports, factories, etc., that create the impression of an overall theme for a given tile or series of tiles. In a preferred embodiment, the themed tiles are formed from pre-molded plastic, and are shaped and/or painted to exhibit a selected themed details. In this manner, a given tile 172 having a theme is ready for play immediately.

By way of example, as shown in FIG. 25, a themed tile may be provided having themed scenery details 150 representing a river canyon 188*a*, an airport 188*b*, a national park, an army base 188*c*, a rock quarry FIG. 24, a residential neighborhood 188*d*, sports facilities 188*e*, a freight yard 188*f*, a refinery 188*g*, a cityscape 188*h*, a rural town, a seaside setting, or other thematic scenes. A themed tile having themed scenery details such as those shown in FIG. 25 provides a pre-formed, near ready-to-play toy train set environment, requiring only simply assembly which can be accomplished by a child. A toy train set using various themed tiles 188 has an increased play value, as the arrangement of various tiles creates different play environments that can be easily modified due to the quick and easy assembly of the tiles of the present invention. By joining various themed tiles 188*a-h* together, a multi-themed toy train set is created, and a multi-themed play environment provides the option of using additional toys with the themed "world" or playset created by the themed tiles of the present invention.

Figure 26:
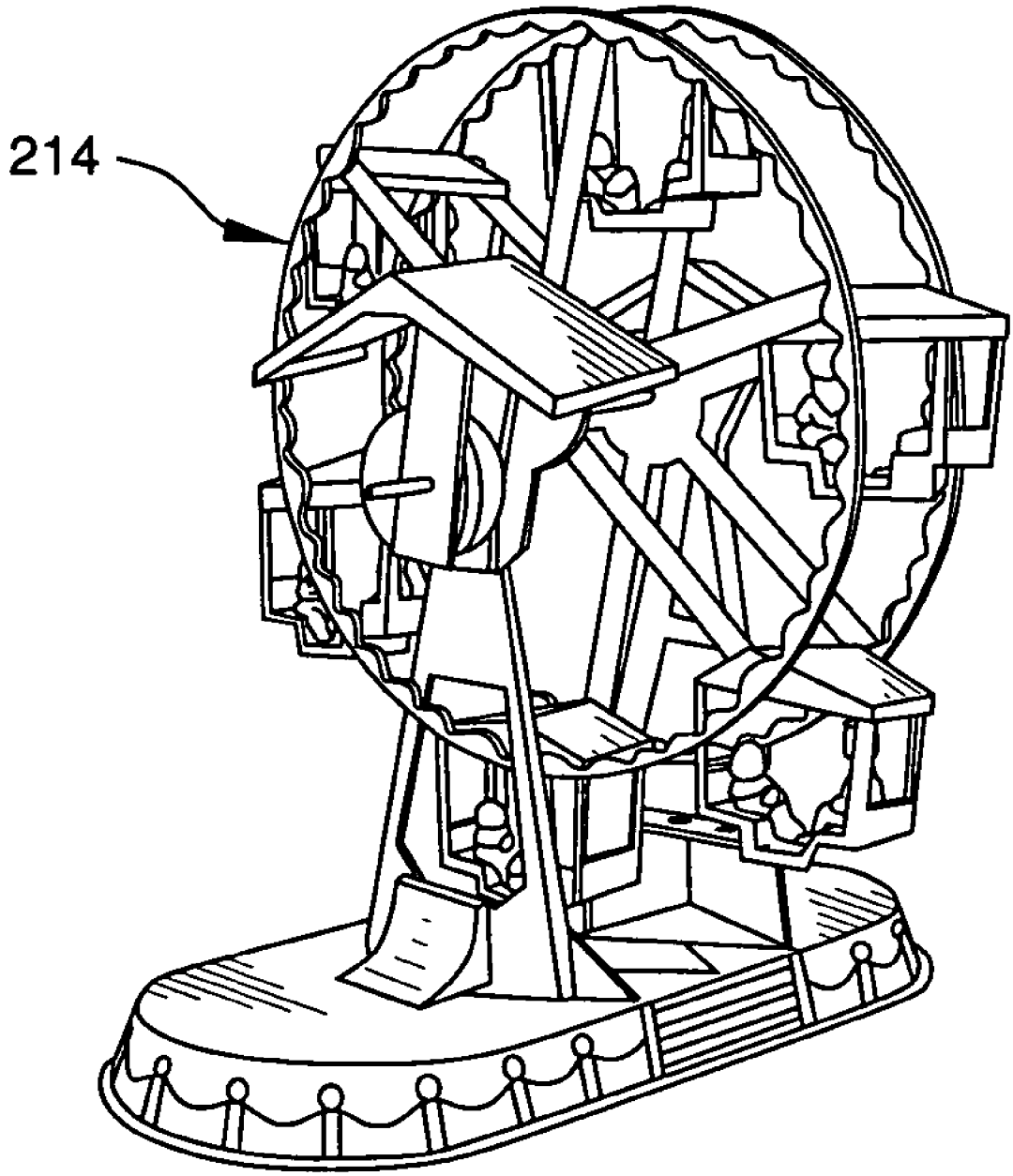
FIG. 26 shows a perspective view of a toy train accessory having a moving part.
Figure 27:
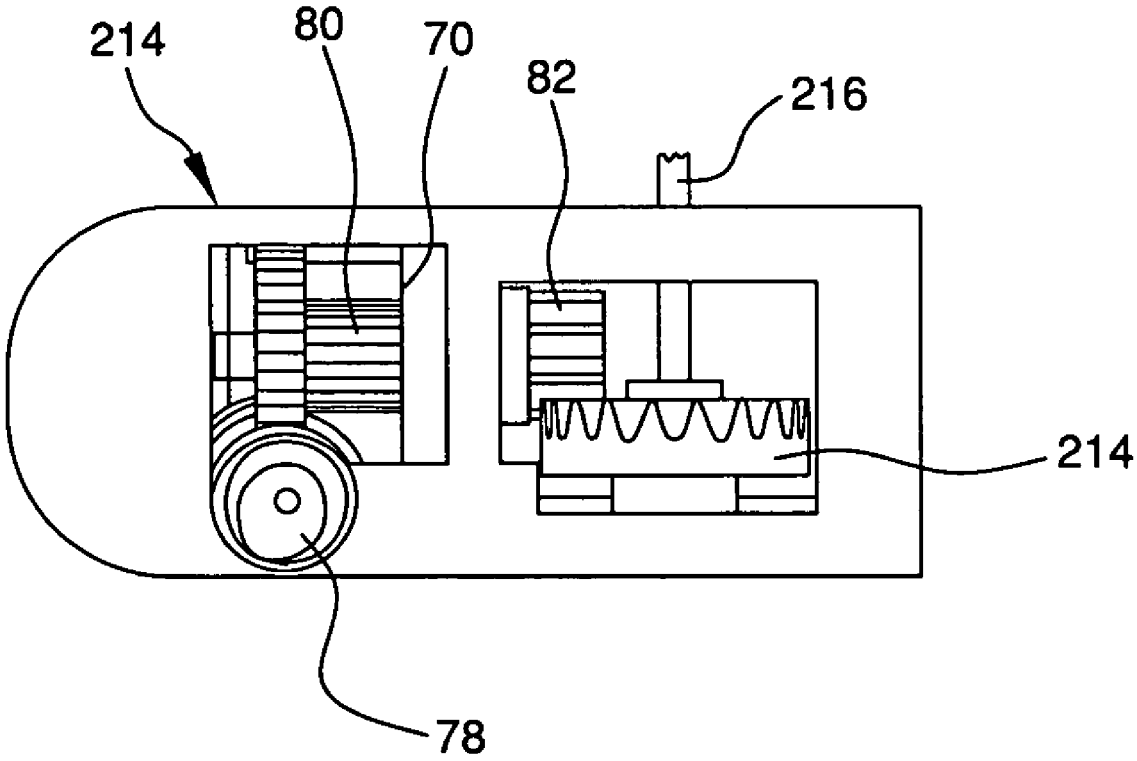
FIG. 27 shows a bottom plan view of the toy train accessory shown in FIG. 26.

The toy train set of the present invention may also have a train set accessory having at least on moving part, and the drive assembly 70 may be using to operate such moving parts. For example, a toy train set accessory may be a ferris wheel 214, as shown in FIGS. 26 and 27, although many other toy train set accessories having moving parts are within the scope of the present invention, such gates having arms that raise and lower, draw bridges, vehicles that move between positions, representations of people, etc. Shown in FIG. 27 is the underside of the ferris wheel shown in FIG. 26. The ferris wheel 214 has a actuator 216 that includes a gear 214 for engaging the driving gear 82 of the drive mechanism 74 of the drive assembly 70. Actuator 216 may have gears, not shown, and be connected to a moving part to operate the moving part. The train set accessory 212 has a receiving portion for accepting the drive assembly. The drive assembly 70 can thus be used to operate the moving part of the train set accessory 212. The storage case 102 may further include a recess for storing the train set accessory 212. Thus, the drive assembly 70 may be used to operate not just the toy train 10 of the present invention, but toy train accessories as well.

In use, the play value of a toy train set according to the present invention can be derived from various aspects of the invention. The toy train 10 can be assembled and disassembled, and can be stored in a generally flattened arrangement in a convenient storage case. The tiles, which are generally flat or can be easily broken down to a flat pack, can easily be arranged as the user wishes. The connection system assures smooth and level transition between elevated rails of adjacent tiles. Where themed tiles are used, themed environments can be created sparking imaginative play. The elevated tracks of the tiles additionally create a realistic setting.

While the preferred embodiments of the invention have been described in detail, the invention is not limited to the specific embodiments described above which should be considered as merely exemplary. Further modification and extensions of the present invention may be developed, and all such modifications are deemed to be within the scope of the present invention as defined by the appended claims.

What is claimed is:

1. A toy train comprising: a base portion including wheels for engaging a toy train track; a folding body comprising at least two adjacent body segments connected by a hinge, the folding body adapted to engage the base portion in an assembled position; wherein the folding body can be stored in a generally flattened arrangement when disassembled; and, a drive assembly for driving at least one of the wheels, the drive assembly adapted to removably engage the base portion.

2. The toy train of claim 1, wherein at least one of the body segments has a connection portion for removably engaging an adjacent one of the body segments in an assembled position.

3. The toy train of claim 1, wherein the body segments include complementary connection portions.

4. The toy train of claim 1, wherein at least a portion of the folding body is connected to the base by a removable connection.

5. The toy train of claim 1, wherein at least a portion of the folding body is connected to the base by a hinge.

6. The toy train of claim 1, wherein the adjacent body segments are connected via a living hinge.

7. The toy train of claim 1, wherein the drive assembly further comprises an integrated motor and drive gear for driving at least one of the wheels.

8. The toy train of claim 7, wherein at least one of the wheels has a gear for engaging the drive gear of the drive assembly.

9. The toy train of claim 7, wherein the motor is electric and the drive assembly further comprises a holder for an electrical power source.

10. The toy train of claim 1, wherein the drive assembly further comprises a wind-up spring driven motor for powering the drive assembly.

11. The toy train of claim 1, wherein the body segments lie substantially flat when the train is completely disassembled.

12. The toy train of claim 1, wherein the folding body has a first profile when assembled and a second profile when disassembled, and the profile of the folding body is reduced for storage by creating a decreased or flattened profile when disassembled as compared to the assembled profile.

13. A folding body toy train comprising: at least two adjacent body segments connected by a hinge, at least one of the body segments having a connection portion for removably engaging an adjacent body segment in an assembled position; a base portion including wheels for engaging a toy train track connected to at least one of the body segments, the base portion having a second connection for removably engaging at least one of the body segments, wherein the body segments can be stored in a generally flattened arrangement when disassembled; and, a drive assembly for driving at least one of the wheels, the drive assembly adapted to removably engage the base portion.

14. The toy train of claim 13, wherein at least one of the body segments is connected to the base by a removable connection.

15. The toy train of claim 13, wherein the body segments have complementary connection portions.

16. The toy train of claim 13, wherein the body segments are connected via a living hinge.

17. The toy train of claim 13, wherein the drive assembly further comprises an integrated motor and drive gear for driving at least one of the wheels.

18. The toy train of claim 17, wherein at least one of the wheels has a gear for engaging the drive gear of the drive assembly.

19. The toy train of claim 13, wherein the motor is electric and the drive assembly further comprises a holder for an electrical power source.

20. The toy train of claim 13, wherein the drive assembly further comprises a wind-up spring driven motor for powering the drive assembly.

21. The toy train of claim 13, wherein the body segments lie substantially flat when the train is completely disassembled.

22. The toy train of claim 13, wherein the folding body has a first profile when assembled and a second profile when disassembled, and the profile of the folding body is reduced for storage by creating a decreased or flattened profile when disassembled as compared to the assembled profile.

* * * * *